United States Patent [19]

Levine et al.

[11] 4,434,323

[45] Feb. 28, 1984

[54] SCRAMBLER KEY CODE SYNCHRONIZER

[75] Inventors: Stephen N. Levine, Schaumburg; Ezzat A. Dabbish, Buffalo Grove; John P. Byrns, Schaumburg, all of Ill.

[73] Assignee: Motorola, Inc., Schaumburg, Ill.

[21] Appl. No.: 278,251

[22] Filed: Jun. 29, 1981

[51] Int. Cl.[3] ..... H04K 1/00

[52] U.S. Cl. ..... 178/22.17; 178/22.14; 179/1.5 S

[58] Field of Search ..... 179/1.5 E, 1.5 R, 1.5 S; 178/22.13, 22.14, 22.06, 22.16, 22.17; 340/825.34

[56] References Cited

U.S. PATENT DOCUMENTS

| | | | |
|---|---|---|---|
| 3,610,828 | 10/1971 | Girard | 179/1.5 S |
| 3,659,046 | 4/1972 | Angeleri et al. | 178/22.13 |
| 3,730,998 | 5/1973 | Schmidt et al. | 370/104 |
| 3,773,997 | 11/1973 | Guanella | 200/159 B |
| 3,824,467 | 7/1974 | French | 179/1.5 R |
| 3,852,534 | 12/1974 | Tilk | 179/1.5 S |
| 3,921,151 | 11/1975 | Guanella | 179/1.5 S |
| 3,991,268 | 11/1976 | Goodall | 178/22.16 |
| 3,991,271 | 11/1976 | Branscome et al. | 179/1.5 R |
| 4,020,285 | 4/1977 | Beanscome et al. | 179/1.5 S |
| 4,052,565 | 10/1977 | Baxter et al. | 179/1.5 S |
| 4,058,677 | 11/1977 | Maitland et al. | 179/1.5 R |
| 4,100,374 | 7/1978 | Jayant et al. | 179/1.5 R |
| 4,107,458 | 8/1978 | Constant | 178/22.06 |
| 4,149,035 | 4/1979 | Frutiger | 179/1.5 S |
| 4,157,454 | 6/1979 | Becker | 178/22.06 |
| 4,160,120 | 4/1979 | Barnes et al. | 178/22.07 |
| 4,171,513 | 10/1979 | Otey et al. | 179/1.5 E |
| 4,188,580 | 2/1980 | Nicolai et al. | 179/1.5 R |
| 4,221,931 | 9/1980 | Seiler | 179/1.5 R |
| 4,268,715 | 5/1981 | Atalla | 340/825.34 |
| 4,268,720 | 5/1981 | Olbert et al. | 179/1.5 R |
| 4,302,628 | 11/1981 | Akrich | 179/1.5 S |

OTHER PUBLICATIONS

Shift Register Synthesis and BCH Decoding, Jan. 1969, James L. Massey, vol. IT-15, No. 1.

*Primary Examiner*—Sal Cangialosi

*Attorney, Agent, or Firm*—Charles L. Warren; Edward M. Roney; James W. Gillman

[57] ABSTRACT

A method for synchronizing the scrambling sequences of communicating scrambler units of a privacy communications system in a reliable and secure manner. The method is particularly adapted for use in noisy or fade prone transmission environments, and permits late entry of authorized third parties to the system. The method utilizes digital sequences interleaved periodically with scrambled analog information to provide reliable synchronization.

17 Claims, 19 Drawing Figures

SCRAMBLER KEY CODE SYNCHRONIZER

BACKGROUND OF THE INVENTION

I. Field of the Invention

The present invention relates generally to communication systems for secure transmission of audio signals and more particularly to a method for synchronizing the scrambling sequences of communicating scrambler units in a reliable and secure manner.

II. Description of the Prior Art

Communication systems have been developed which serve to prevent unauthorized persons from intercepting and acquiring the transmitted intelligence communicated therefrom. These systems are based upon a psuedo-random scrambling of the speech signals prior to transmission so as to render the transmission unintelligible and therefore secure with respect to unauthorized third parties who may intercept the transmission.

Two general approaches have been developed for enciphering speech. The first approach contemplates converting the analog speech signals into digital signals and linking the digital pulses in conventional manner with one another by means of key pulses which are generated by a key generator. The thus enciphered characters are transmitted to the receiver end and then converted into deciphered analog speech. However, this type of prior art system requires a large bandwidth for transmission purposes and the equipment is sensitive to phase shifts in the transmission system.

The second prior art approach does not transform the speech signals into digital form. The speech information is subdivided into partial groups along the frequency axis or time axis. These partial groups are then permuted by key information generated by a key generator so that there is produced a new sequence of the partial groups. Yet the information as such is still accommodated within the same frequency band thus permitting a narrowband scrambling system. However, it has been found that the simple transposition of sub-groups provides insufficient security against deciphering. Accordingly, some of these narrowband systems periodically change the scrambling algorithm and then transfer coded key information for descrambling between communicating scrambler units to provide greater security against deciphering. Such prior art systems transmit coded key information at the beginning of a transmission and the receiving unit uses this information to descramble the transmission. This approach is unreliable in noisy environments or in environments where fading is common. In addition, these systems do not permit late but authorized entry into the system by a third party.

SUMMARY OF THE INVENTION

It is an object of this invention therefore to provide a key code synchronizing method for a narrowband scrambler system which is particularly adapted for use in noisy or fade prone transmission environments.

It is another object of the invention to provide a key code synchronizing method for a narrowband scrambling system which permits late entry of authorized third parties to the system.

Briefly, according to the invention, a key code synchronization method is provided for a narrowband privacy communication system for communicating analog information wherein frames of the analog information are partitioned into sub-frames and the sub-frames are scrambled using a scrambling algorithm which is changed during transmission to permit secure transmission. The key code synchronization and method comprises the steps of generating successive digital sequences at a first station and scrambling each frame of the analog information such that the scrambling algorithm is unambiguously related to the digital sequences. The digital sequences are then transmitted from the first station interleaved periodically with the scrambled frames of the analog information. At least two transmitted digital sequences and the transmitted scrambled analog information are detected at a second station. The scrambled analog information is then descrambled utilizing the digital sequences.

BRIEF DESCRIPTION OF THE DRAWINGS

The features of the present invention which are believed to be novel are set forth with particularity in the appended claims. The invention, together with further objects and advantages thereof, may best be understood by reference to the following description when taken in conjunction with the accompanying drawings.

FIG. 17 is a program flow diagram of the MEMMAP routine of the computer program for the central processor of the privacy scrambling system illustrated in FIG. 1.

DESCRIPTION OF THE PREFERRED EMBODIMENT

Figure 1:
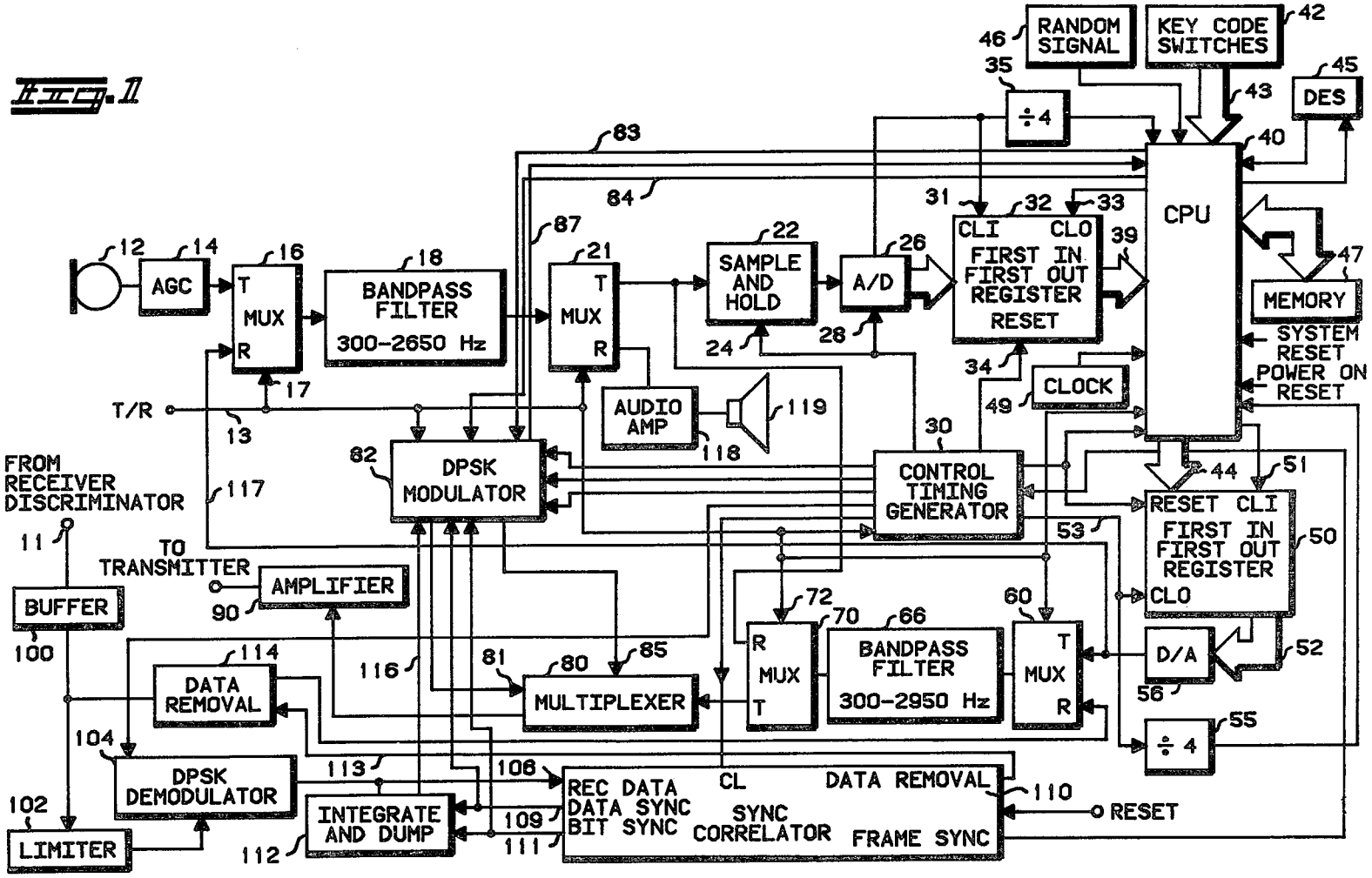
FIG. 1 is a generalized block diagram illustrating the preferred embodiment of a privacy scrambling system utilizing the novel key code synchronization method.
Figure 3:
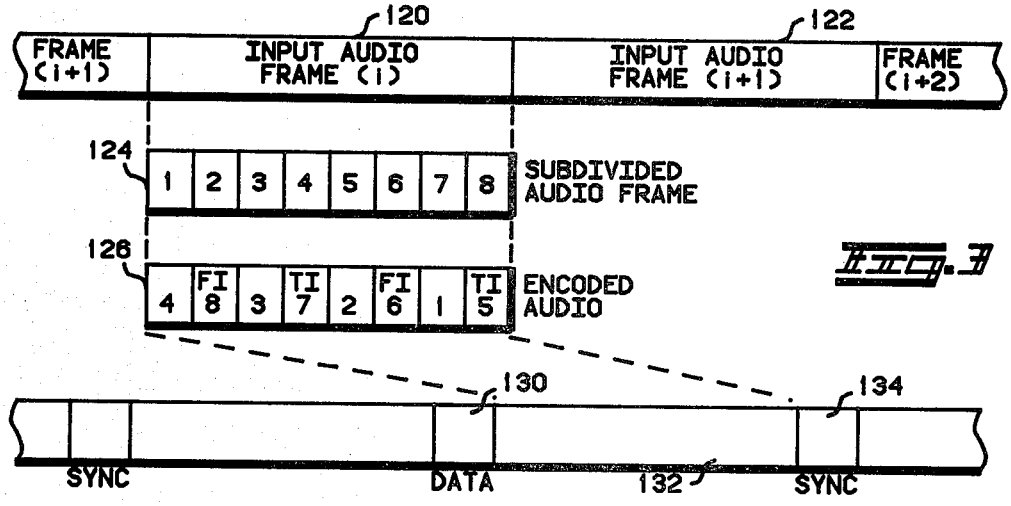
FIG. 3 is a diagram illustrating the method of scrambling utilized by the privacy communication scrambler illustrated in FIG. 1.

FIG. 1 is a generalized block diagram illustrating a narrowband privacy communication scrambler system utilizing the key code synchronizer according to the invention. Here, a voice signal applied to the microphone 12 is scrambled using three basic scrambling methods: frequency inversion, time inversion, time segment permutation. The time segment permutation is achieved by dividing the input speech into consecutive time frames as illustrated by frames 120 and 122 of FIG. 3. In the preferred embodiment the time frames are 256 milliseconds in length. Each frame is then subdivided into eight equal length sub-frames (see frame 124 of FIG. 3) which are transmitted in a permuted order (see frame 126, FIG. 3). In the preferred embodiment the sub-frames are made 32 milliseconds in length. The complete segment processing scheme is the result of applying frequency and/or time inversion to some of the individual segments (sub-frame) within the frame. (see frame 126, FIG. 3).

During transmission of the encoded audio, the scrambling algorithm is changed every frame, therefore the system must provide synchronization and decoding information to the receiver. Thus, as each frame is outputted it is speeded up so that it is possible to insert a binary sequence for synchronization and decoding information between successive transmitted audio frames as illustrated at 130, 132 and 134 of FIG. 3. In the preferred embodiment, each 256 millisecond frame is speeded up by a factor of 1.125, thus requiring approximately 227.56 milliseconds to transmit (thereby compressing the audio signal). Thus, an interframe time window of 28.44 milliseconds is made available between each audio frame into which is inserted a digital burst. The digital bursts alternate between a 32 bit synchronization word and a 31 bit data word. The sync word is correlated at the receiver to provide frame and bit synchronization. Since the scrambling algorithms are changed every frame, the data bursts provide information to the receiver scrambling unit as to what scrambling algorithm sequence is being used by the transmitter unit. Each data burst is made up of an 11 bit data word encoded to 31 bits (a (31,11) BCH code) to provide error correction.

Referring again to FIG. 1, a voice signal is coupled from microphone 12 through an automatic gain control circuit 14 to the transmit input of a multiplex circuit 16 (e.g. Motorola MC14053). During the transmission mode a T/R signal generated from the PTT of the transmitter (not shown) is applied to the control input 17 of the multiplex circuit 16 on the T/R control line 13. As a result, the multiplex circuit 16 couples the voice signal from the transmit input to a bandpass filter 18 where the voice signal is limited to the desired bandwidth (300–2650 Hz in the preferred embodiment). The bandwidth limited audio signal is then coupled to the input of a multiplexer 21 and coupled, during the transmit mode, to a sample-and-hold circuit 22, as shown. The sample-and-hold circuit 22 samples the audio signal applied to its input and couples the sample to an A/D converter 26. This process is controlled by control signals generated by the control timing generator 30 and applied to the control input 24 of the sample-and-hold circuit 22 and the control input 28 of the A/D converter 26 as shown. The A/D converter 26 converts the analog sample to a digital word which is coupled as shown to a first-in first-out register 32. The first-in first-out register 32 permits a series of digitized samples from the A/D converter (four in the preferred embodiment) to be stored for a period of time and controlled by signals from the control timing generator 30 applied to the control input 34 and by clock signals applied to the input clock (CLI) input 31. The digitized samples in the register 32 are coupled to the CPU 40 via the bus 39 under control of a signal from the CPU 40 coupled to the clock out (CLO) terminal 33. In this preferred embodiment a microprocessor such as the Motorola 6800 is utilized to perform the functions of the CPU 40. Coupled to the CPU 40 is the output of a divider 35 which provides an output interrupt pulse to the CPU 40 to indicate that four samples have been stored in the register 32 to be transferred to the CPU memory. Also coupled to the CPU 40 is a memory 47 for data and program storage, a system reset and power on reset, and a clock 49.

The digitized samples from the register 32 are processed in the CPU 40 to provide a scrambled output on the output bus 44. The scrambling algorithm performed in the CPU 40 is determined by a set of key code switches 42 coupled to the CPU 40 via the bus 43, a random signal from a random signal generator 46, and a DES (Data Encryption Standard) chip 45 (e.g. a Motorola MC6859) coupled as shown to the CPU. This process will be described in greater detail hereinafter. The scrambled digitized samples are coupled from the CPU 40 via the bus 44 to a first-in first-out register 50 as shown. The first-in first-out register 50 permits a number of digitized samples to be temporarily stored and coupled via the bus 52 to the D/A converter 56 under the control of a control timing generator 30. The timing generator 30 provides control signal to reset the register to clock out (CLO) the data in the register 50. The register 50 is loaded under the control of a clock in (CLI) signal applied to the CLI input 51. The D/A converter 56 converts the scrambled digitized samples to analog signals which are then coupled as shown to the transmit input of a multiplexer 60. The multiplexer 60 under the control of the T/R signal in the transmit mode couples the analog scrambled signal from the transmit input of the multiplexer 60 to a bandpass filter 66. The bandpass filter 66 has a higher cut off frequency than the bandpass filter 18 since the processed analog signal is compressed and therefore contains higher frequency components. The filtered analog scrambled signal is then coupled from the bandpass filter 66 to the input of multiplexer 70, as shown. During the transmit mode, in response to a transmit signal on the T/R control line 13 coupled to the input 72, the multiplexer 70 will couple the analog signal to a second multiplexer 80 (e.g. Motorola MC14053). Also coupled to the multiplexer 80 is a DPSK modulator circuit 82 (to be more fully described hereinafter) which is coupled as shown to the CPU 40 via the conductors 83, 84 and 87. The CPU 40 generates a coded data word and the DPSK modulation circuit 82 generates a sync word, which is to be inserted alternately between the compressed scrambled analog frames. These digital sequences are DPSK modulated by the DPSK modulator 82 and coupled to the multiplexer 80 at the input 81. In addition, signals from the timing control generator 30 are applied to the DPSK modulator circuit 82 as shown. The DPSK modulator circuit also generates a control signal applied to the multiplexer input 85. As a result, the multiplexer 80 inserts the data and sync words between the compressed scrambled analog frames as described hereinbefore. This composite signal is then coupled directly to the amplifier 90 and the amplified signal is coupled to a transmitter for transmission.

In the receive mode a signal from the receiver discriminator is applied to the input 11 of FIG. 1 and a receive signal is generated from the PTT and applied to the T/R control line 13. The receive signal is coupled through a buffer 100 to a limiter circuit 102. The limited signal is then coupled from the limiter 102 to a DPSK demodulator 104 where the data and sync information is demodulated and coupled to the received data input 106 of the sync correlator 110. A suitable DPSK demodulator 15 disclosed in U.S. Pat. No. 4,190,802 issued to Stephen Levine, and assigned to Motorola, Inc.

The sync correlator 110 processes the demodulated data and sync sequences and generates bit, data, and frame synchronization pulses as well as a data removal pulse. Also coupled to the sync correlator 110 are a master clock signal and a reset signal. The bit sync output 111 and the data sync output 109 of the sync correlator 110 are coupled as shown to an integrate and dump circuit 112 and to the DPSK modulator 82. The integrate and dump circuit 112 is also coupled to the DPSK demodulator 104. The output of the integrate and dump circuit 112 is the detected data word utilized to decipher the scrambled analog signal. This data word is coupled to the DPSK modulator 82 via the conductor 116. The frame sync output of the sync correlator 110 is coupled as shown, to the control timing generator 30, and the data removal output of the correlator 110 is coupled to a data removal circuit 114. The functioning of the sync correlator 110 will be more fully disclosed hereinafter.

The signal from the buffer 100 is also coupled as shown to the data removal circuit 114 which is controlled by data removal pulses applied to the input 113 from the sync correlator 110. The data removal circuit 114 is simply a blanking circuit which blanks the data and sync intervals of the received signal and couples the received scrambled analog signal with data and sync words blanked to the receive input of the multiplexer 60. Under the control of the receive signal on the T/R control line 13, the multiplexer 60 couples the received scrambled analog signal through the bandpass filter 66 to the multiplexer 70. The multiplexer 70 couples the signal from the bandpass filter 66 to the input of the sample-and-hold circuit 22, as shown. The sample-and-hold circuit 22 in response to signals applied to the input 24 from the control timing generator 30, samples the scrambled analog signal and couples the samples to the A/D converter 26. The A/D converter 26 in response to signals applied to its control input 28 from the control timing generator 30 digitizes the analog samples and couples them to the first-in first-out register 32 under the control of the control timing generator 30 at the CLI input 31. The first-in first-out register permits the digitized samples to be temporarily stored and then coupled to the CPU 40 via the bus 39 under the control of the CPU 40 and thru the CLO input 33. The digitized samples of the scrambled analog signal are then processed in the CPU 40 to unscramble the signal. The processing of the scrambled signal will be described in greater detail hereinafter. The unscrambled signal is then coupled to the first-in first-out register 50 via the bus 44. The first-in first-out register 50 permits the digitized samples of the unscrambled signal to be temporarily stored and then applied via the bus 52 to the D/A converter 56, as shown. The digitized samples are applied to the D/A 56 in response to signals from the control timing generator applied to the clock out (CLO) terminal 53. The same signal is divided by a divider 55 and applied to the CPU 40, as shown, as an output interrupt pulse to indicate that four samples have been shifted out of the register 50. The D/A converter converts the digitized unscrambled signal to an analog signal which is then coupled via the conductor 117 to the receive input of the multiplexer 16. The multiplexer 16 under the control of the T/R control line 13 couples the unscrambled analog signal from the conductor 117 to the bandpass filter 18. The bandpass filter 18 filters the signal to the required bandwidth and couples the filtered signal to the multiplexer 21. The multiplexer 21 under the control of the T/R control line 13 couples the unscrambled analog signal to the audio amp 118 and then to the speaker 119, as shown.

Figure 2:
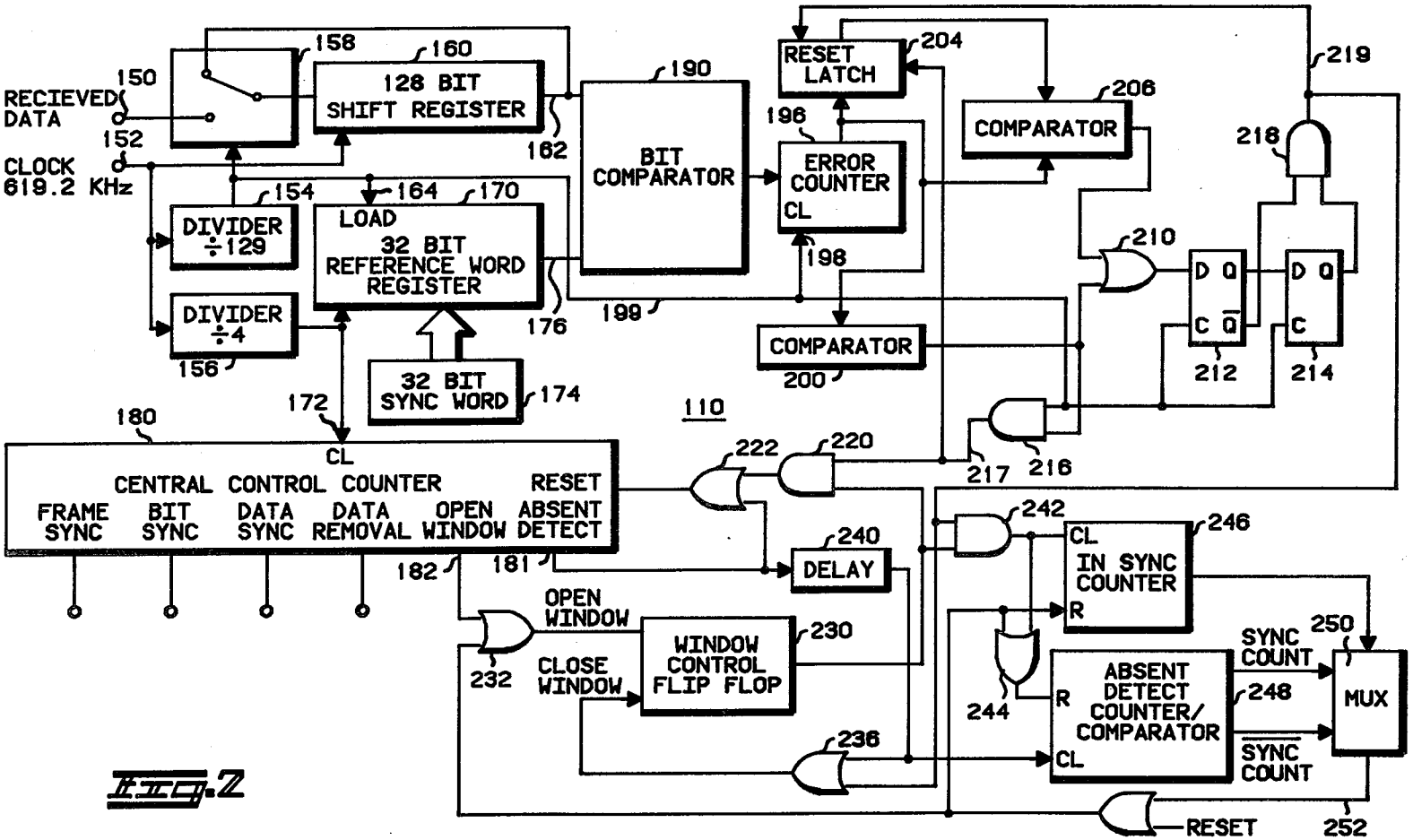
FIG. 2 is a detailed block diagram of the sync correlator illustrated generally in FIG. 1.

Referring now to FIG. 2, there is shown a detailed block diagram of the synchronization correlator 110 illustrated generally in FIG. 1. The received data signal (at 1200 bits per second) from the DPSK demodulator shown in FIG. 1 is applied to the input 150, and a clock signal of 619.2 KHz is applied to the clock input 152 from the control timing generator 30 also shown in FIG. 1. The clock signal is coupled as shown, to the dividers 154 and 156, and to a 128 bit shift register 160. The divided signal from the divider 154 is a 4.8 KHz signal coupled to the switch 158 and to the load input 164 of a 32 bit register 170, while the output of the divider 156 couples a 154.8 KHz signal as shown, to the register 170 and to the clock input 172 of a central control counter 180. As a result, the received signal is sampled by the switch 158 at four times the bit rate. After each sample the switch returns to the feedback position shown and the 619.2 KHz clock coupled to the register 160 shifts all 128 bits around the register so that each is applied to the output 162 and coupled as shown to a comparator 190. At the same time the sample is taken, a 32 bit reference word stored in the register 174 is loaded into the register 170 due to a clock pulse on the input 164 from the divider 154 on the conductor 199. This reference word, the synchronization word to be detected, is shifted through the register 170 at one fourth the rate of the register 160 by the signal from the divider 156, so that each bit is applied to the output 176 and coupled as shown to the comparator 190. Thus the incoming 1200 bit per second data is sampled at four samples per bit and then compared to the 32 bit reference word. The output of the comparator 190 is coupled to an error counter 196 as shown, which counts the number of mismatches. The signal coupled from the divider 154 to the clock input 198 of the error counter 196 clears the error counter before the next sample. The error count of the error counter 196 is coupled to a comparator 200 and compared to a fixed threshold (23 in the preferred embodiment). If the error count does not exceed the threshold, a high detect signal is coupled to the OR gate 210 and to the AND gate 216, as shown. Since the second input of the AND gate 216 is coupled to the clock line 199 the high on gate 216 will result in a detect pulse at the output 217 when a clock pulse occurs. The output of 217 is also coupled to the latch 204 as shown, thus the detect pulse will cause the latch 204 to store the error count when a detect occurs. In addition, a comparator 206, coupled to the output of the error counter 196 and the output of the latch 204, compares the present error count with the previous error count which was stored in the latch 204 when a bit detect occurred. If the present error count is lower than the last error count, a high detect update signal is generated and coupled to the OR gate 210, as shown. This second comparison insures that the most accurate detection is utilized. The OR gate 210 couples the detect signals to a flip-flop 212. The clock signal on conductor 199 is also coupled, as shown, to the clock input of the flip-flop 212, as well as to the clock input of a flip-flop 214, as shown. In addition, an AND gate 218 is coupled to the $\overline{Q}$ output of the flip-flop 212 and the Q output of the flip-flop 214, as shown, resulting in a closed window pulse being generated at the output 219 of the AND gate 218 whenever a detect or detect update does not occur following a detect on the previous clock pulse.

The detect pulse from the output 217 of the AND gate 216 is coupled to an AND gate 220, as shown, and if the gate 220 is enabled, the detect pulse is coupled through an OR gate 222, to the reset input of the central control counter 180, as shown. An open window signal from a window control flip-flop 230 is coupled to the AND gate 220, enabling the gate during an open window period, which is a period of time during which the circuit will accept a detect. The window control flip-flop 230 is set to open the window by a signal from the open window output 182 of the central control counter 180, coupled as shown, through an OR gate 232. The window control flip-flop 230 is also set by a reset signal coupled from the OR gate 234 through the OR gate 232, as shown. The open window period is closed by a close window pulse coupled from the output 219 of the AND gate 218 to the close window input of the window control flip-flop 230, through an OR gate 236, as shown. If no detect of the synchronization word occurs for a complete cycle (512 milliseconds in the preferred embodiment) an absent detect pulse is generated at the output 181 of the central control counter 180 and coupled to the OR gate 222 as shown. This results in a detect reset of the counter 180, in the absence of a true detect signal. In addition the absent detect signal is delayed (approximately 4 milliseconds) by the delay circuit 240, and coupled to the close window input of the window control flip-flop 230. As a result, the window is closed after allowing a short period for a late detect signal to reset the central counter 180 after the absent detect signal has occurred. This results in a flywheel effect such that the circuit can continue to generate synchronization signals even if the synchronization word is not always detected because the synchronization words are known to be 512 milliseconds apart. To control the flywheeling, a counter system made up of gates 242, 244 and 234, counters 246 and 248, and a multiplexer 250 coupled as shown, is provided. The close window pulse, from the AND gate 218 is coupled to an AND gate 242 and passed through to the IN SYNC counter 246 whenever the window control flip-flop 240 output is high (i.e. the window is open). The IN SYNC counter 246 generates an output signal whenever two consecutive detects are counted, and the output signal is coupled, as shown, to the multiplexer 250. Thus, two sequential true detects cause the multiplexer to couple the SYNC count of the absent detect counter to the output 252, otherwise the SYNC count is coupled to the output 252. The output of the AND gate 242 is also coupled to the reset of the absent detect counter 248 through the OR gate 244 and the delayed absent detect signal is coupled, as shown, to the clock (CL) input of the absent detect counter 248. The absent detect counter counts the consecutive absent detects and compares the count to two fixed thresholds, a SYNC and a $\overline{\text{SYNC}}$ threshold. The SYNC threshold is 8 in the preferred embodiment and the $\overline{\text{SYNC}}$ threshold is 2. The absent detect counter 248 generates a signal on the sync output when the count exceeds 8 and on the $\overline{\text{SYNC}}$ output when the count exceeds 2. As a result, if two consecutive true detects are counted by the IN SYNC counter 246 the system is determined to be in synchronization and eight consecutive absent detects will have to occur before a signal is coupled to the output 252 of the multiplexer 250. This signal is then coupled, as shown, to reset the IN SYNC counter and open the window by resetting the window control flip-flop 230 to allow the system to search for a new detect. If less than two true detects have occurred, then only two absent detect pulses are needed to reset the system to search for a detect.

Once a detect has reset the central control counter 180, the counter 180 counts the clock pulses coupled to the clock input 172. The counter has six decoded outputs. A frame sync output which indicates the start of the next frame, a bit sync output which provides bit timing pulses, a data sync output which generates a pulse at the beginning of the data word, a data removal output which generates a pulse for the duration of the data and sync periods, an open window output and an absent detect output. The first four outputs are utilized in the privacy scrambler system as shown in FIG. 1.

Figure 4:
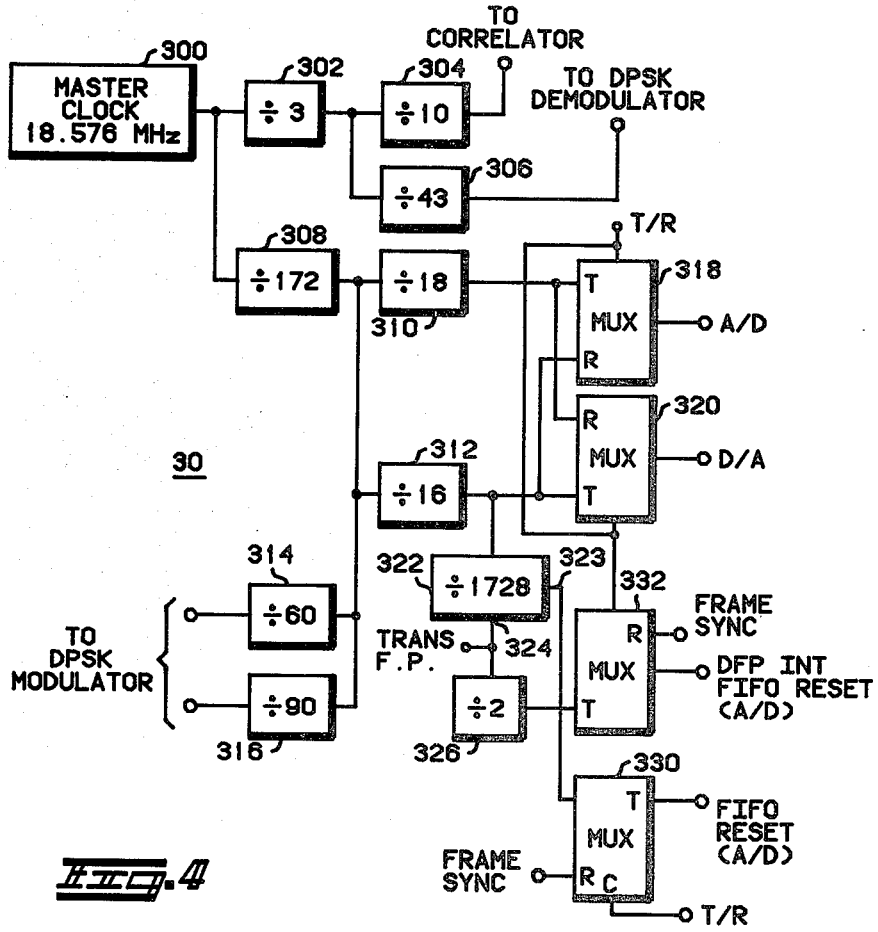
FIG. 4 is a detailed block diagram illustrating the Control Timing Generator shown generally in FIG. 1.

FIG. 4 is a detailed illustration of the control timing generator 30 shown in FIG. 1. The control timing generator 30 is composed of a master clock 300 coupled to a series of dividers as shown to generate a variety of signals at different frequencies. The output of the master clock 300 (in the preferred embodiment at a rate of 18.576 MHz) is coupled as shown to a divider 302 in series with the divider 304 to generate a 619.2 KHz signal to provide the necessary clock signal for the correlator shown in FIG. 1. In addition in series with the divider 302 is a divider 306 coupled as shown to provide a 144 KHz clock signal to the DPSK demodulator circuit shown in FIG. 1. A divider 308 is also coupled to the output of the master clock 300 and the output of the divider 308 is coupled to dividers 310, 312, 314 and 316 as shown. The output of the divider 314 provides an 1800 Hz output and the divider 316 provides a 1200 Hz output to the DPSK modulator. The output of the divider 310 is coupled to the transmit input of a multiplexer 318 and to the receive input of a multiplexer 320. The output of the divider 312 is coupled as shown to the transmit input of the multiplexer 320 and the receive input of the multiplexer 318. The multiplexers 318 and 320 are controlled by a transmit receive pulse such that during the transmit mode the output of multiplexer 318 is a 6 KHz signal from the divider 310 and during the receive mode the output is a 6.75 KHz signal from the output of the divider 312. The output of the multiplexer 320 will be 6 KHz during the receive mode and 6.75 KHz during the transmit mode. The output signal of the multiplexer 318 is coupled to the A/D converter shown in FIG. 1 and the output of the multiplexer 320 is coupled to the D/A converter of FIG. 1. In addition the 6.75 KHz output of the divider 312 is coupled through a divider 322 to provide a transmit frame pulse at the output 324 which is coupled to a divider 326 as shown. The second output 323 of the divider 322 is also coupled to the transmt input of a multiplexer 330 and the output of the divider 326 is coupled to the transmit input of the multiplexer 332. The receive input of the multiplexer 332 is a frame sync pulse coupled from the correlator shown in FIG. 1 and the receive input of the multiplexer 330 is also the frame sync pulse from the correlator. The multiplexers 332 and 330 are controlled by the transmit receive signal generated from the PTT of the transmitter receiver circuit. As a result, during the transmit mode the multiplexer 332 will couple the output of the divider 326 to the CPU as a double frame interrupt (DFPINT) and during the receive mode will couple the frame sync pulse to the CPU as a double frame interrupt (DFPINT) signal. Also the multiplexer 330 during the transmit mode will couple the output of the divider 322 to the A/D FIFO register 32 of FIG. 1 and during the receive mode will couple the frame sync pulse to the FIFO reset of the FIFO 32 as shown in FIG. 1.

Figure 5:
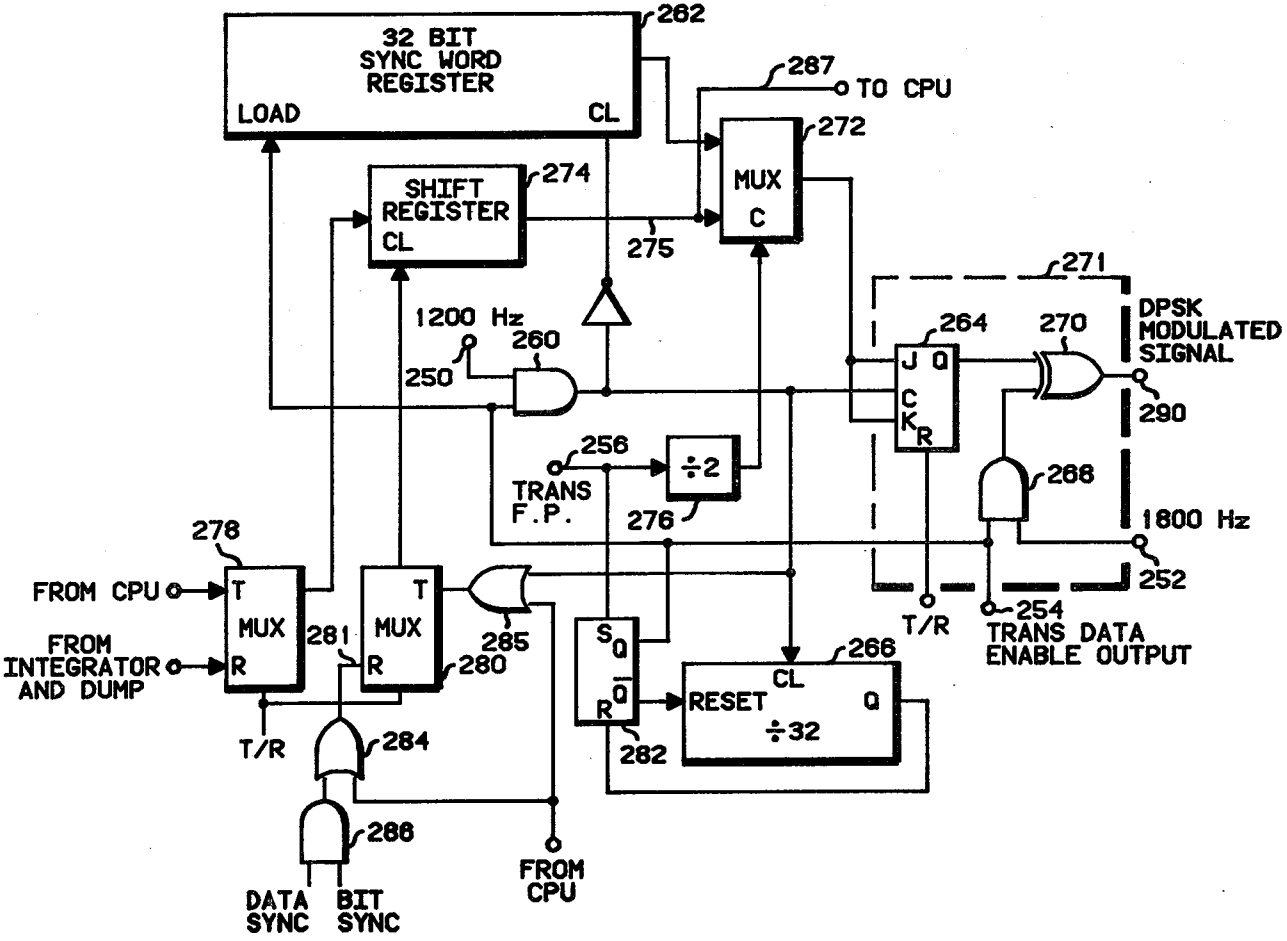
FIG. 5 is a detailed block diagram of the DPSK modulator shown generally in FIG. 1.

FIG. 5 illustrates in greater detail the DPSK modulator 82 shown generally in FIG. 1. A 1200 Hz signal is applied to the input terminal 250, an 1800 Hz signal is applied to the input terminal 252, and a transmit frame pulse is applied to an input 256. Each of these signals is generated by the control timing generator 30 shown in detail in FIG. 4. The 1200 Hz clock signal applied to the input 250 is coupled as shown to an AND gate 260. The output of AND gate 260 is coupled through an inverter to the clock input of a 32 bit sync word register 262 as shown, and to the clock inputs of a flip-flop 264, a divide by 32 counter 266, and thru an OR gate 285 to the transmit input 281 of a multiplexer 280. The 1800 Hz signal applied to the input 252 is applied to an AND gate 268 which is part of the DPSK modulator indicated generally by reference numeral 271. The output of AND gate 268 is coupled to an exclusive OR gate 270 the output of which is the DPSK modulated signal. Coupled to the second input of the exclusive OR gate 270 is the Q output of the flip-flop 264. Both the J and K inputs of the flip-flop 264 are coupled to the output of a multiplexer 272. The DPSK modulator 271 functions in the conventional manner to DPSK modulate data applied from the multiplexer 272. One input of the multiplexer 272 is the output of the sync word register 262 as shown, and the other input is output 275 of the shift register 274. In addition the transmit frame pulse applied to the input 256 is coupled through a divider 276 to the control input of the multiplexer 272. The shift register 274 is a storage register of 32 bits which has its input coupled to the output of a multiplexer 278, as shown. The multiplexer is controlled by a transmit receive input such that during the transmit mode the data word from the CPU (shown in FIG. 1) is coupled into the shift register 274 and during the receive mode the detected data word from the integrate and dump circuit 112 (shown in FIG. 1) is coupled into the register 274. The clock input of the register 274 is coupled to a multiplexer 280, as shown. The multiplexer 280 is also controlled by a transmit receive signal such that during the transmit mode the shift register 274 shifts its contents to its output under the control of signals from the OR gate 285, while during the receive mode the shift register 274 is clocked by a clock signal coupled from the receive input 281 of the multiplexer 280. In addition, the transmit frame pulse applied to the input 256 is coupled directly to the set input of a flip-flop 282 as shown. The reset input of the flip-flop 282 is coupled to the Q output of the divider 266 as shown and the Q output of the flip-flop 282 is coupled to the reset input of the divider 266. The $\overline{Q}$ output of the flip-flop 282 is coupled, as shown, to the AND gate 260. The load input of the register 262, and to the transmit data enable output 254.

The DPSK modulator circuit of FIG. 5 functions as follows. During the transmit mode the transmit receive (T/R) signal switches the multiplexers 278 and 280 to the transmit condition. A data word from the CPU is applied to the transmit input of the multiplexer 278 and coupled directly to the shift register 274. A clocking signal from the CPU is applied through the OR gate 285 to the transmit input of the multiplexer 280. The multiplexer 280 couples this clock signal through to the clock input of the shift register 274 clocking the data word from the mutliplexer 278 into the shift register 274. When a transmit frame pulse occurs at the input 256 the flip-flop 282 is set thus enabling the AND gate 260 and 268 and enabling the divider 266. As a result, the 1200 Hz signal is coupled through the AND gate 260 to the divider 266, to the modulation circuit 271, and to the OR gate 285. The 1200 hz signal coupled to the OR gate 285 will be applied thru the multiplexer 280 to the clock input of the shift register 274, thus clocking the data out to the multiplexer 272. The transmit frame pulse applied to 256 will also be coupled through the divider 276 to the multiplexer 272 thus switching the multiplexer to transmit the data word through the multiplexer 272 to the modulation circuit 271 where the data word is DPSK modulated and coupled to the output 290. On alternate frames the transmit frame pulse applied to the input 256 having been divided through the divider 276 will switch the multiplexer to the sync word register 262 and couple the sync word to the DPSK modulation circuit 271 where it will be DPSK modulated and applied to the output 290. The sync word is clocked out of the register 262 by the 1200 Hz clock signal applied to the input 250 and coupled through the AND gate 260, then through an inverter to the clock input of the register 262. The divider 266 counts 32 pulses of the 1200 Hz clock and upon counting 32 pulses resets the flip-flop 282 thereby disabling the gate 260 and 268 until the next transmit frame pulse is applied. In addition, this output of the flip-flop 282 is coupled to the transmit enable output 254 to control the multiplexer 80 (see FIG. 1) to insert the data and sync words into the outgoing information stream at the proper time.

During the receive mode the T/R signal will be coupled to the multiplexer 278 and 280 switching them to the receive condition and to the flip-flop 264, disabling the JK inputs. During the receive mode, the data word from the integrate and dump circuit is applied to the receive input of the multiplexer 278 and coupled into the shift register 274. In addition the data sync and bit sync pulses from the correlator are combined in an AND gate 286 and coupled through the OR gate 284 to receiver input of the multiplexer 280. The multiplexer 280 couples this clock signal to the clock input of the shift register 274 thereby clocking in the data from the integrate and dump circuit (see FIG. 1) to the shift register 274. Subsequently, clock pulses from the CPU will be applied to the OR gate 284 and coupled to the receive input of the multiplexer 280 which will couple the clock pulses from the OR gate 284 to the clock input of the shift register 274. As a result the data previously shifted into the register 274 will be clocked out to the CPU via the conductor 287.

The CPU 40 (see FIG. 1) is programmed to respond to the interrupts previously described, the T/R pulse (T/R is a nonmaskable interrupt generated from the PTT when a transmit/receiver mode change occurs), the double frame pulse (DFP interrupt), the input pulse (input interrupt), and the output pulse (output interrupt). Thus there are four interrupt service routines FRMNG, OUTPUT, INPUT, and TRCONT. In addition several background routines are provided which perform required calculations and data manipulation in the periods between interrupts.

Figure 8:
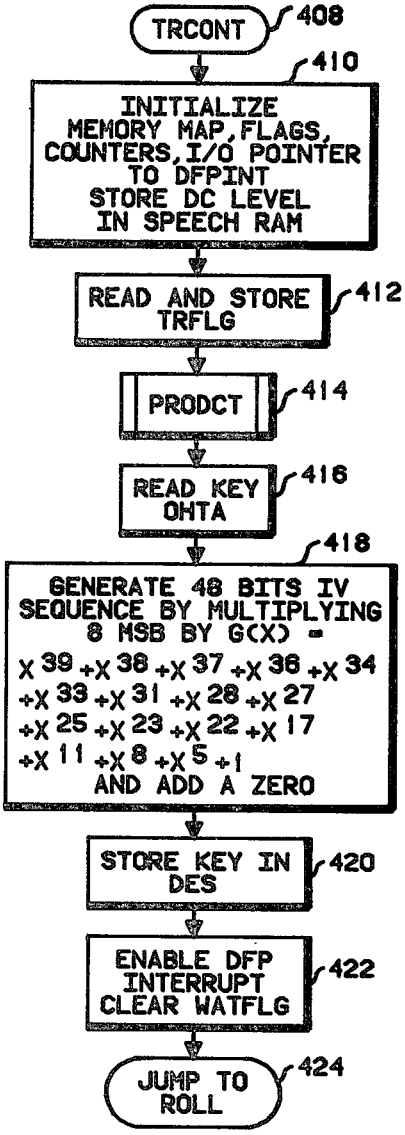
FIG. 8 is a program flow diagram of the TRCONT routine of the computer program for the central processor of the privacy scrambling system illustrated in FIG. 1.
Figure 9:
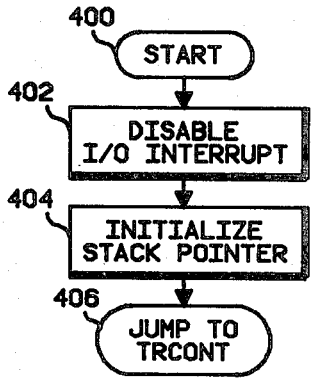
FIG. 9 is a program flow diagram of the START routine of the computer program for the central processor of the privacy scrambling system illustrated in FIG. 1.

Upon turn on of the system, the START routine illustrated in FIG. 9 is entered at location 400, the IO interrupt is disabled as shown at 402 and the stack pointer is initialized at block 404, as shown. The program flow then proceeds to jump to the TRCONT routine (see FIG. 8) as shown at location 406.

Refer now to FIG. 8 program flow proceeds from the entry point 408 to initialize required flags, counters, and memory locations, as well as setting the IO interrupt pointer to DFPINT, as shown at block 410. In addition, the speech memory RAM is initialized to a zero DC level. Program flow then proceeds to block 412 where the transmit receive flag (TRFLG) is read and stored in memory. Program flow then proceeds to the subroutine PRODCT as shown at block 414. The subroutine PRODCT is shown in FIG. 17 and will be described in detail hereinafter. Upon return from the subroutine PRODCT the program proceeds to block 416 where the input key data is read and stored. The eight most significant bits of this data is then used to generate a 48 bit IV sequence by multiplying the eight most significant bits by the generating polynomia, indicated in block 418 and then adding a zero to the end of the sequence. Following the multiplication indicated at block 418, the key information is loaded into the DES input register as indicated at block 420 and program then proceeds to enable the double frame pulse interrupt (DFPINT) and clear the wait flag (WATFLG), as shown at block 422. As indicated at 424 the program then jumps to the roll routine shown in FIG. 6.

Figure 6:
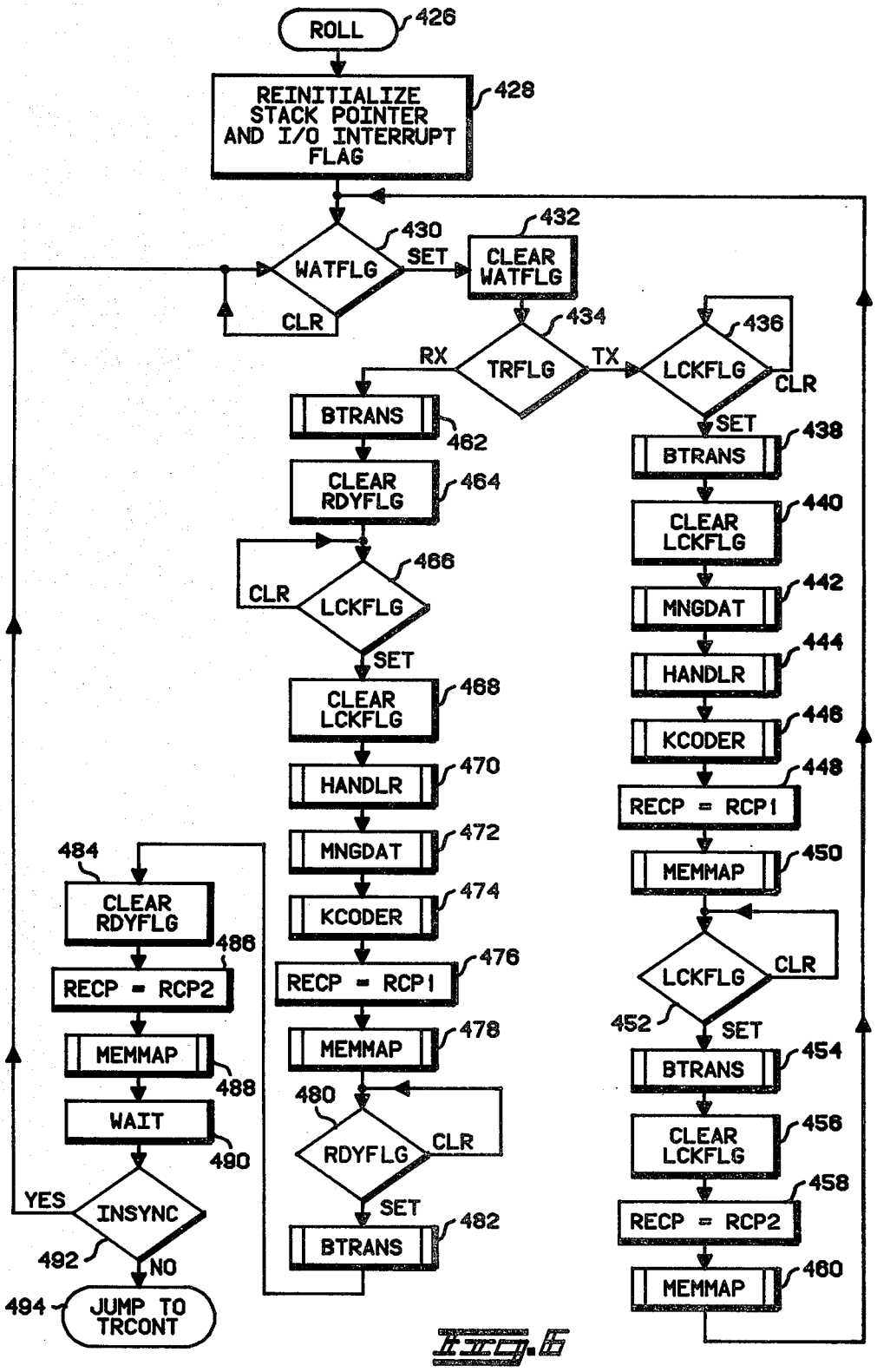
FIG. 6 is a program flow diagram of the ROLL routine of the computer program for the central processor of the privacy scrambling system illustrated in FIG. 1.

FIG. 6 is a detail flow diagram of the ROLL routine which is entered at location 426 and as indicated at 428 reinitializes the stack pointer and clears the IO interrupt flag. Program flow then proceeds to block 430 where WATFLG is tested to determine if it is set or clear. If WATFLG cleared as indicated at block 430 the program returns to block 430 and continues to wait until the DFPINT occurs, which will result in a change in the status of WATFLG. When an interrupt occurs, the interrupt will cause the program control to execute the interrupt polling routine shown in FIG. 7.

Figure 7:
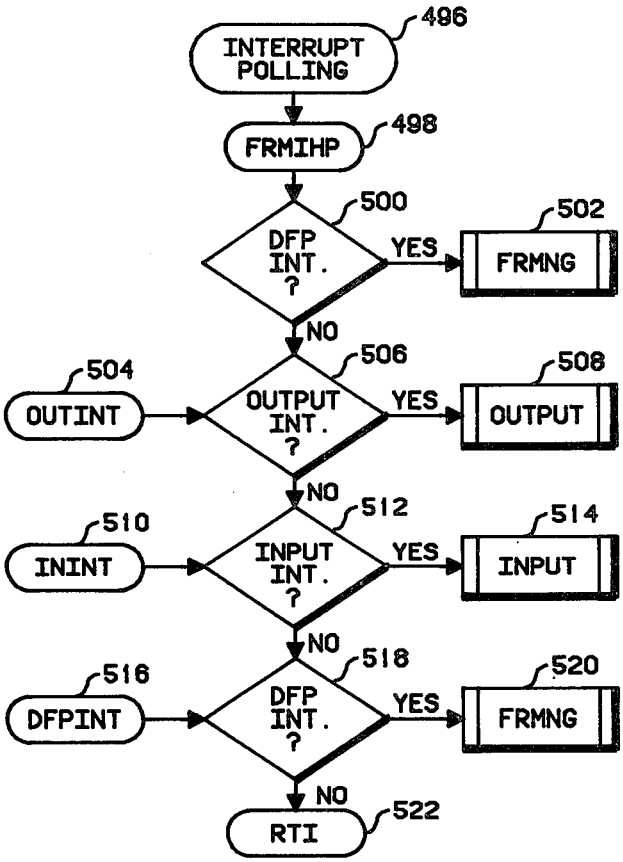
FIG. 7 is a program flow diagram of the Interrupt Polling routine of the computer program for the central processor of the privacy scrambling system illustrated in FIG. 1.

Referring to FIG. 7 it can be seen that there are several entry points to the interrupt polling routine shown at locations 498, 504, 510 and 516. When an interrupt occurs, the interrupt polling routine 496 will be entered at that point which is determined by the address of the interrupt address pointer, which is set at various points throughout the program. Thus, if the interrupt point has been set to the FRMIHP address and an interrupt occurs, the interrupt polling routine will be entered at 496. Program flow will then proceed to block 500 where the interrupt will be tested to determine if it is a DFPINT interrupt, and if it is, the program flow will proceed to the FRMNG interrupt service routine as shown at block 502. If the interrupt is not a DFPINT interrupt then program flow proceeds to block 506 where the interrupt is tested to determine if it is an OUTPUT interrupt. The program flow proceeds to block 502 to the OUTPUT interrupt service routine if it is, and if not the program flow proceeds to block 512. At block 512, the interrupt is tested to determine if it is the (ININT), if it is ININT, then the program proceeds to block 514, the INPUT service routine, and if not, the program flow proceeds to block 518. At block 518 the interrupt is again tested to determine if it is DFPINT, and if it is the program flow proceeds to the FRMNG routine as indicated at block 520. If the interrupt is not DFPINT then the program flow returns to the interrupt point and proceeds, as indicated, at block 522. Ihus, for example, if a DFPINT occurs while the ROLL routine of FIG. 6 is in the wait condition indicated at block 430, the program flow will go to the interrupt polling routine of FIG. 7 and be directed to the interrupt service routine FRMNG shown in FIG. 10.

Figure 10:
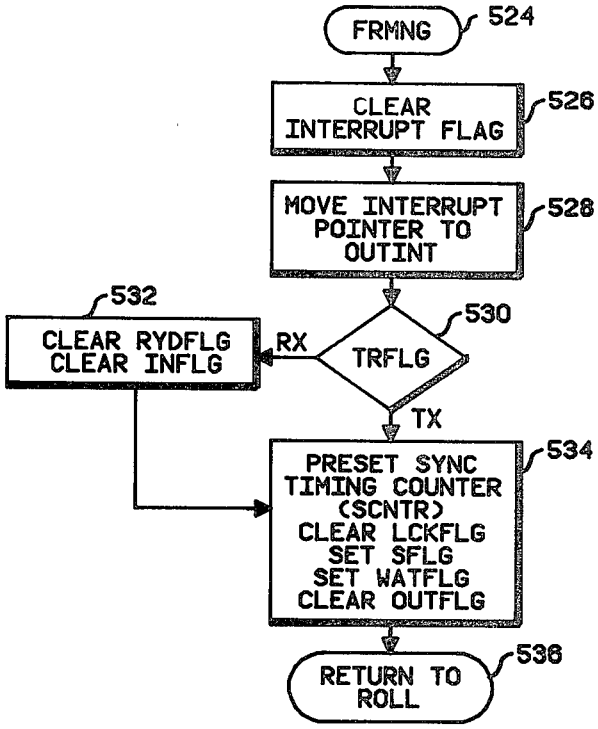
FIG. 10 is a program flow diagram of the FRMNG routine of the computer program for the central processor of the privacy scrambling system illustrated in FIG. 1.

Referring to FIG. 10 the subroutine FRMNG is entered at block 524 and immediately at block 526 the interrupt flag is cleared and at 528 the interrupt address pointer is moved to OUTINT. Then the program flow proceeds to block 530 where the TRFLG is tested to determine whether the system is in the transmit or receive mode. If in the receive mode the program flow proceeds to block 532 where ready flag (RDYFLG) and the input flag (INFLG) are cleared. The program flow then would proceed to block 534. During the transmit mode the program flow proceeds directly from 530 to 534 where the sync timing counter (SCNTR) is present, sync flag SFLG and WATFLG are set and the lock flag (LCKFLG) is cleared. The sync timing counter establishes the times during which the sync word or data word occur. Thus at this point WATFLG is set so that when the program flow returns to the ROLL routine of FIG. 6 the program will be able to proceed. At block 536 the program flow then returns to the roll routine of FIG. 6.

Returning to FIG. 6 at block 430 the wait flag will again be tested but was set in the FRMNG routine and therefore program flow proceeds to block 432. At block 432 WATFLG is cleared and the program flow proceeds to block 434 where TRFLG is tested. If the system is in the transmit mode, the program flow then proceeds to block 436 where LCKFLG is tested to determine whether it is clear or set. If the LCKFLG is clear the program flow returns to the test of block 436 and continues this procedure thus waiting until an interrupt occurs which will change the condition of LCKFLG to set. When LCKFLG has been set, then program flow will proceed to block 438 where the background routine BTRANS is called. The BTRANS routine, which will be described in detail hereinafter, primarily updates the memory map with current values to be used to scramble the incoming audio information. Program flow will then proceed to block 440 where LCKFLG is cleared and program then proceeds to block 442 where the MNGDAT background routine is called. The MNGDAT background routine, which will be described in greater detail hereinafter, primarily manages the generation of the 11 bit data word used to generate the scrambling algorithm sequence. After returning from the MNGDAT background routine program flow then proceeds to block 444 to the HANDLR background routine. The HANDLR background routine, to be described in greater detail hereinafter, primarily handles the (31, 11) BCH encoding of the data word. Upon return from the HANDLR background routine program flow proceeds to block 446 where the KCODER background routine is called. The KCODER routine, to be described in greater detail hereinafter, primarily handles the processing of 11 bit data words through the DES (Data Encryption Standard) to obtain 14 bit encoding words. Upon return from the KCODER subroutine the program flow proceeds to block 448 where the recipe word RECP is set to be equal to the first recipe word RCP1 determined by the KCODER routine of block 446. Program flow then proceeds to block 450 where the MEMMAP subroutine is called. The MEMMAP subroutine, to be described in greater detail hereinafter, establishes a memory map (MEMTBL) table which determines the exact scrambling process to be performed by the processor. Upon return from the MEMMAP subroutine the program flow then proceeds to block 452.

It should be noted that throughout the processing previously described frequent input (ININT) and output (OUTINT) interrupts are occuring (an input interrupt for every four samples to be input and an output interrupt for every four samples to be output). Thus each of the background routines will be frequently interrupted by an IO interrupt, which will cause program flow to proceed to one of the interrupt service routines after which program flow will return to the point of the interrupt and continue as described above.

At block 452 LCKFLG flag is tested and if it is clear the program flow returns to retest and the program remains in a wait state until an interrupt service routine changes LCKFLG flag to set. Once LCKFLG is set, program flow proceeds to block 454 where the BTRANS routine is called and upon return from the BTRANS routine, program flow proceeds to block 456 where LCKFLG is cleared. Program flow then proceeds to block 458 where the recipe word (RECP) is set equal to the second recipe word (RCP2) determined by the KCODER routine indicated at block 446. Program flow then proceeds to block 460 where the MEMMAP subroutine is called and a new MEMTBL is determined using the new RECP. Program flow then returns to block 430 as shown and the routine again waits until WATFLG is changed from clear state by one of the interrupt service routines.

Once WATFLG flag is set program flow will again proceed to block 432 where it is cleared. The program flow will then proceed to test TRFLG as shown at 434, and if the system is now in the receive mode, program flow will proceed to block 462 where the BTRANS background subroutine is called. Again it should be noted that each of the background subroutines is subject to frequent IO interrupts which after being serviced by an IO interrupt service routine will continue from the point of the interrupt. From 462 program flow proceeds to 464 where RDYFLG is cleared and program flow will then proceed to block 466 where LCKFLG is tested. If LCKFLG is clear the program remains in the wait state until an interrupt service routine changes LCKFLG to set then the program flow proceeds to block 468 where LCKFLG is cleared. The program then proceeds to the HANDLR routine as indicated at 470 and then to the MNGDAT subroutine as indicated at 472. Upon return from the routine MNGDAT the program proceeds to block 474 where the KCODER subroutine is called, and upon return, the recipe word RECP is set equal to RCP1 as indicated at 476. Program flow then proceeds to block 478 where the MEMMAP routine is called and upon return, the program flow proceeds to block 480 where RDYFLG is tested. If RDYFLG is clear the program continues testing the flag and remains in a wait condition until the flag has been set at which time the BTRANS routine is called as indicated at 482. Upon return from the BTRANS routine RDYFLG is cleared as indicated at 484 and the recipe word variable RECP is set equal to RCP2 at 486 and then the routine MEMMAP determines a new MEMTBL based on the new RECP as indicated at 488. After return from the MEMMAP routine program flow proceeds to block 489 where a wait period occurs to make certain that the end of a sync period has passed. Program flow then proceeds to 492 where the in synchronization flag (INSYNC) is tested to determine whether the system is still in synchronization or not. If it is not in sync, the program jumps to the TRCONT routine as indicated at 494 and if in sync then program flow returns to the block 430 where WATFLG is tested.

As mentioned previously throughout the ROLL routine IO interrupts occur which cause program flow to proceed to the interrupt polling routine and then to one of the IO servicing routines. The IO servicing routines include FRMNG (FIG. 10), INPUT (FIG. 11), OUTPUT (FIG. 12). The FRMNG routine which services the double frame pulse interrupt (DFPINT) has been previously described.

Figure 11:
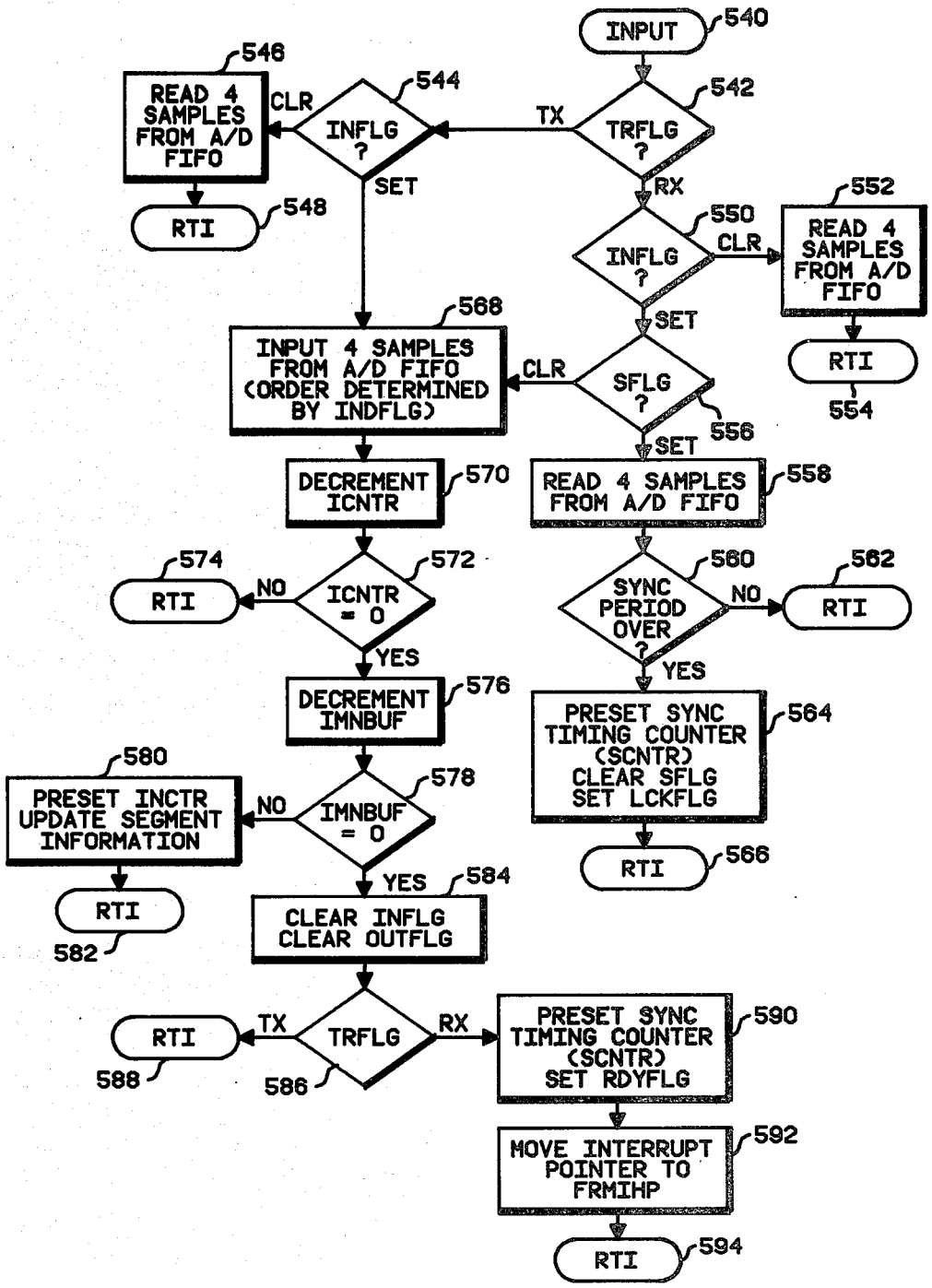
FIG. 11 is a program flow diagram of the INPUT routine of the computer program for the central processor of the privacy scrambling system illustrated in FIG. 1.
Figure 12:
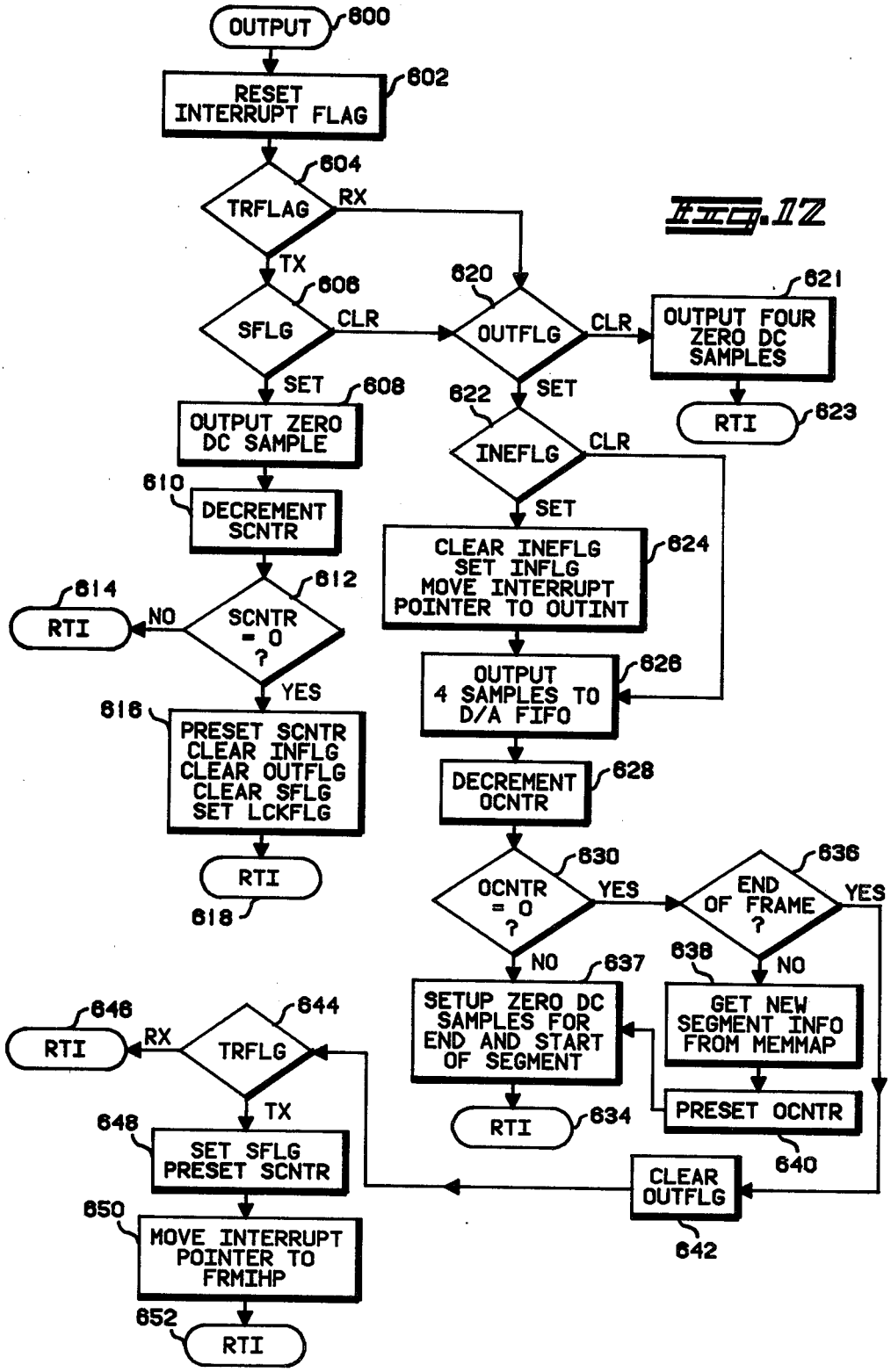
FIG. 12 is a program flow diagram of the OUTPUT routine of the computer program for the central processor of the privacy scrambling system illustrated in FIG. 1.

Referring to FIG. 11 the INPUT routine begins at block 540 and program flow immediately proceeds to 542 to 542 where TRFLG is tested to determine whether the system is in the transmit or the receive mode.

If in the transmit mode program flow proceeds to block 544 where INFLG is tested. If INFLG is clear this indicates that no input to the speech RAM is required and program flow proceeds to block 546 where four samples are read from the A/D FIFO and discarded. The program then returns to the point of the interrupt as indicated at 548. Returning to block 544, if INFLG is set the program proceeds to block 568, where a group of four samples from the A/D FIFO register are input to the current segment memory in either forward or reverse order determined by the input direction flag (INDFLG). Program flow then proceeds to block 570 where the input counter ICNTR is decremented. INCTR is a counter for counting the number of sample groups per subframe. Program flow then proceeds to 572 where ICNTR is tested to determine if it is zero. If not equal to zero the subframe (segment) is not complete and program flow returns to the interrupt point as indicated at 574. If ICNTR is equal to zero the program flow then proceeds to block 576 where input segment counter (IMNBUF) is decremented. IMNBUF is a counter which counts the number of subframes (segments) in the frame. If IMNBUF is not zero this indicates the frame is not complete and as indicated at 580, the INCTR is preset and segment information is updated. Program then returns to the interrupt point as indicated at 582. If IMNBUF is equal to zero, then program flow proceeds to block 584 where the input and output are disabled by clearing INFLG and the output flag (OUTFLG). Program then tests TRFLG as indicated at 586, to determine whether the system is in the transmit or receive mode. If in the transmit mode the program returns to the interrupt point as indicated at 588, and if in the receive mode the program proceeds to block 590 where SCNTR is preset and RDYFLG is set. Program flow then proceeds to block 592, where the interrupt address pointer is moved to the high priority frame interrupt address (FRMIHP), and then the program returns to the interrupt point, as indicated at 594.

The OUTPUT routine is illustrated in detail in FIG. 12 beginning at the entry point 600. Program flow proceeds immediately to block 602 where the interrupt flag is reset and then TRFLG is tested to determine whether the system is in a transmit/receive mode at 604. If in the transmit mode, the program proceeds to block 606 where SFLG is tested whether it is set or clear. If SFLG is set this indicates that the system is in a sync or data period and therefore a zero DC output is desired. Therefore program proceeds to block 608 where zero DC samples are output after which SCNTR is decremented as indicated 610. Program then tests SCNTR to determine if it is equal to zero as indicated at 612. If SCNTR is not equal to zero the program flow returns to the interrupt point as indicated at 614. If SCNTR is equal to zero this indicates that the sync or data period is over and the program presets SCNTR and sets LCKFLG as well as clearing INFLG, OUTFLG, and SFLG as indicated at 616. The program then returns to the interrupt point, as indicated at 618. Returning to block 604, if the system is in the receive mode the program is directed to block 620 where OUTFLG is tested to determine whether it is clear or set. In addition, from block 606, if SFLG is clear program flow proceeds to block 620 to test OUTFLG. If OUTFLG is clear program flow proceeds to block 621 where a set of zero DC samples is output and then returned to the interrupt as indicated at 623. If OUTFLG is set the program proceeds to 622 where the input enable flag (INEFLG) is tested to determine whether it is clear or set. If clear, the program proceeds to block 626 where four samples are output to D/A FIFO register from current segment memory. Alternatively, at the end and beginning of each segment, 4 zero dc samples are output to the D/A FIFO register to reduce discontinuities between segments. If INEFLG is set, INEFLG is cleared, INFLG is set, and the interrupt address pointer is moved to the OUTINT address, as indicated at 624. The program then proceeds to block 626 where four samples are output, and then to 628 where the output counter (OCNTR) is decremented. The output counter (OCNTR) counts the number of groups of samples per segment. Program flow then proceeds to 630 where the OCNTR is tested to see if it is equal to zero. If OCNTR is not equal to zero then a set of DC samples to be inserted at the end and at the start of the segment are set up, as indicated at 632, after which the program returns to the interrupt point, as indicated at 634. If OCNTR is equal to zero this indicates the end of a segment, and the program proceeds to block 636 where the end of frame determination is made. If it is not the end of a frame then program flow proceeds to block 638 and gets the next segment information from the MEMTBL. The program then proceeds to block 640, where OCNTR is preset. The program proceeds to block 632, where the zero DC samples are set up for the end of segment and then returns to the interrupt point, as indicated at 634. If the end of frame has been reached then program flow proceeds from block 636 to 642, where OUTFLG is cleared and then to the block 644 where TRFLG is tested to determine whether the system is in the transmit or receive mode. If the system is in receive mode the program returns to the interrupt point as indicated at 646 and if in the transmit mode the program proceeds to block 648 where SCNTR is preset and the SFLG flag is set. Program then proceeds to block 650 where the interrupt address pointer is moved to the high priority address (FRMIHP) for the double frame pulse interrupt (DFPINT). The program then returns to the interrupt point, as indicated at 652.

Figure 13:
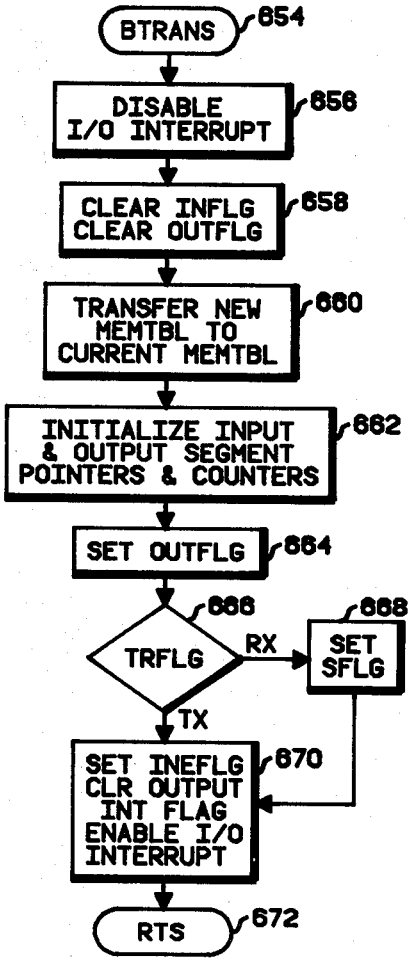
FIG. 13 is a program flow diagram of the BTRANS routine of the computer program for the central processor of the privacy scrambling system illustrated in FIG. 1.

A detailed flow diagram of the BTRANS routine referred to in FIG. 6 is illustrated in FIG. 13 which indicates that the routine is entered at block 654. The routine proceeds to block 656 where the IO interrupt is disabled and then to 658 to clear INFLG and OUTFLG. Program flow then proceeds to 660 where the new MEMTBL determined in the MEMMAP routine, to be described in detail hereinafter is moved to the current MEMTBL. Program then proceeds to 662 where the input and output segment pointers and counters are initialized and then to 664 where OUTFLG is set. Program flow then proceeds to block 666 where TRFLG is tested to determine whether the system is in transmit or the receive mode. If the system is in the receive mode, the program proceeds to block 668 where SFLG is set and then to block 670 where INEFLG is set and the output interrupt flag is cleared and the IO interrupt is enabled. Returning to block 666, if the system is in the transmit mode, the program proceeds directly to block 670, and then from block 670 the program proceeds to return to the calling routine, as indicated in 672.

Figure 14:
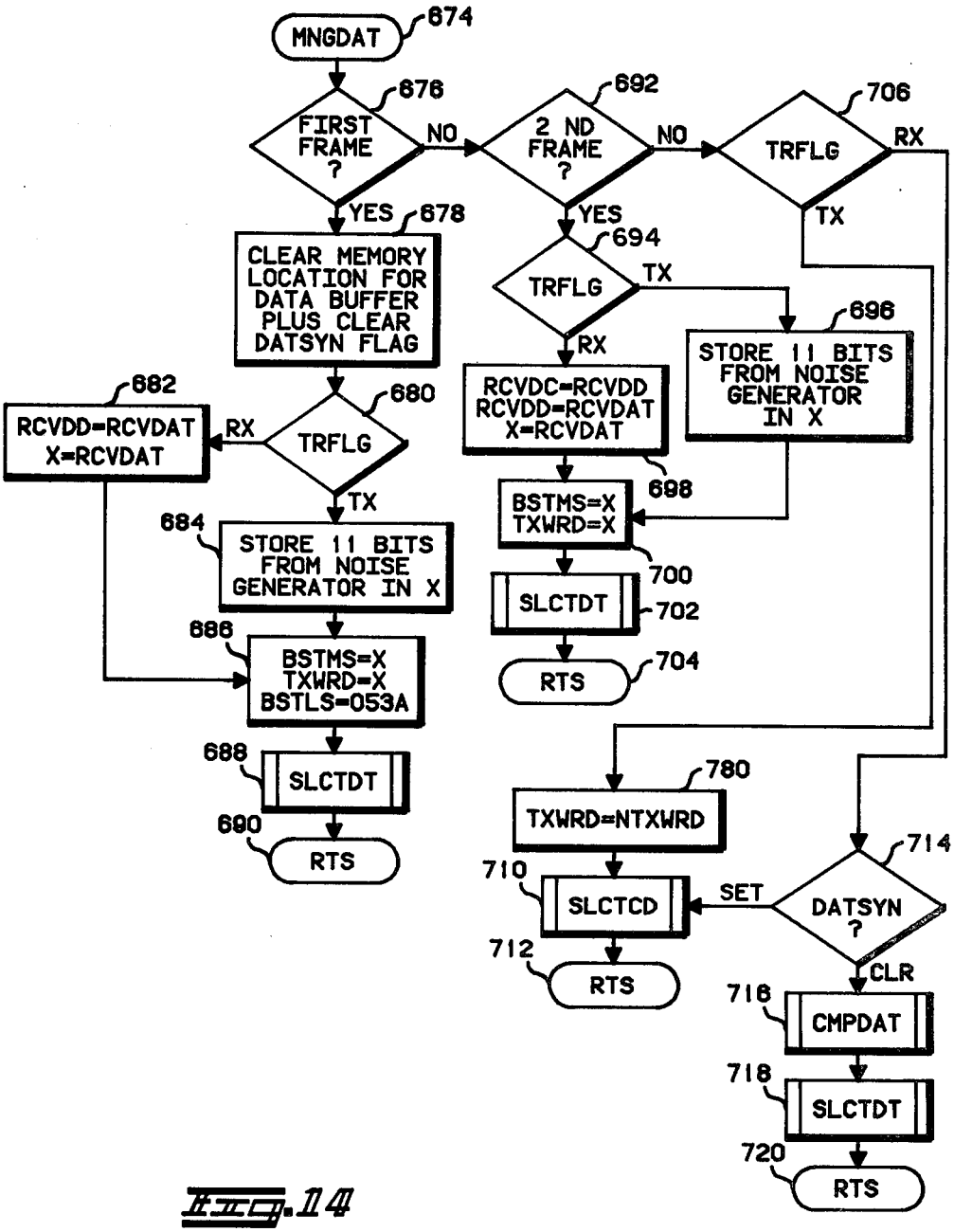
FIG. 14 is a program flow diagram of the MNGDAT routine of the computer program for the central processor of the privacy scrambling system illustrated in FIG. 1.
Figure 11:
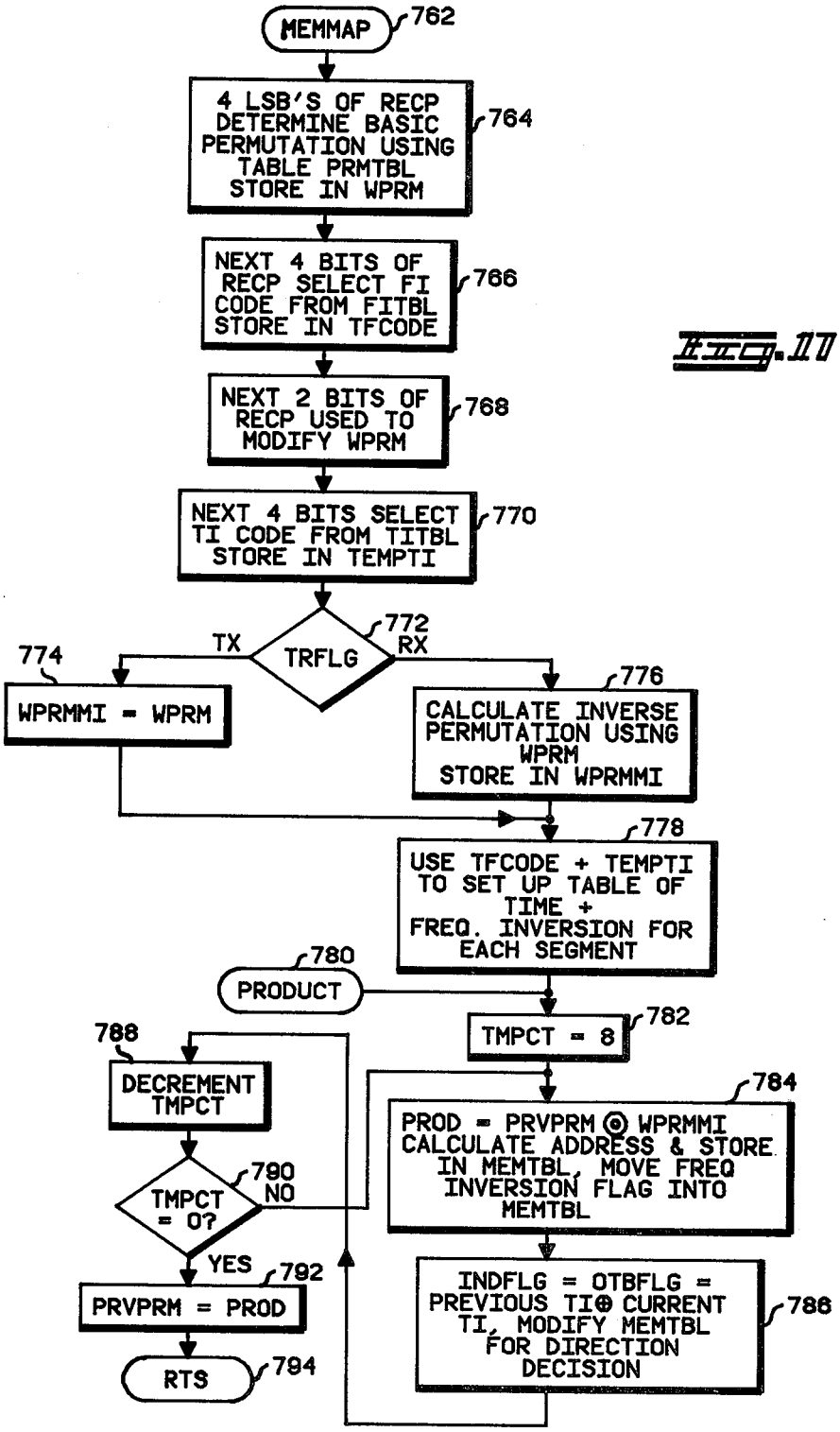

The detailed flow diagram for the MNGDAT subroutine referred to in FIG. 6 is illustrated in FIG. 14. The subroutine MNGDAT is entered at 674 and proceeds to block 676 where a test is made to determine whether the system is in the first frame. If it is the first frame, then the necessary memory locations for the data buffer are cleared and the Data Synchronization flag (DATSYN) is cleared as shown at 678. Program flow will then proceed to block 680 where TRFLG is tested to determine whether the system is in the receive or transmit mode. If in the transmit mode, the program proceeds to block 684, where an 11 bit word is read and stored from the noise generator into index register X. The program then proceeds to block 686 where the variable best most significant word (BSTMS) is set equal to X and the transmitted word (TXWRD) is set equal to X, while the best least significant word (BSTLS) is set equal to a predetermined fixed 11 bit data word as shown. Referring back to block 680, if the system is in the receive mode, the program will proceed to block 682 where the variable RCVDD is set equal to received data (RCVDAT) and where X is set equal to RCVDAT, and then the program proceeds to block 686. From block 686, the program flow proceeds to block 688, where the subroutine SLCTDT is called. Subroutine SLCTDT, to be described in greater detail hereinafter, generates a new 11 bit word based on BSTMS and BSTLS thus permitting flywheeling operation of the system. The subroutine then returns program flow to the calling routine, as indicated at 690. Referring back to block 676, if the first frame test indicates that it is not the first frame, then the program proceeds to block 692 where a test determines whether it is second frame or not. If the system is in the second frame, the program proceeds to block 694 where TRFLG is tested to determine whether in the transmit or receive mode. If in the receive mode the program proceeds to block 698 where the variable RCVDC is set equal to RCVDD, RCVDD is set equal to RCVDAT and X is set equal to RCVDAT. Program flow then proceeds to block 700, where BSTMS is set equal to X, and TXWRD is set equal to X. Referring back to block 694, if the system is in the transmit mode, then the program flow proceeds to block 696 where an 11 bit word from the noise generator is read and stored into X, and then the program proceeds directly to block 700. The subroutine SLCTDT is then called as indicated at 702 and upon return the subroutine MNGDAT returns to the calling routine, as indicated at 704. If at block 692, it was determined that the system was not in the second frame then program flow would proceed to block 706 and TRFLG would be tested to determine whether the system was in the transmit or receive mode. If in the transmit mode, program flow proceeds to block 708 where the variable TXWRD is set equal to next transmitted word (NTXWRD) and the subroutine SLCTCD is called, as indicated at block 710. Upon return from the SLCTCD subroutine program control then returns to the calling routine as indicated at 712. If however, at block 706, the system is in a receive mode, program flow will proceed to block 714 where DATSYN is tested to determine whether it is set or cleared. If DATSYNC is set, program flow will proceed to block 710 and then to block 712, as shown. If however, DATSYNC is clear, then program flow will proceed to block 716, where the CMPDAT subroutine is called. The CMPDAT subroutine, to be described in greater detail hereinafter, primarily does the comparison between the received data word and the expected data words to determine whether the system is in data synchronization. After returning from the CMPDAT subroutine the program proceeds to call the SLCTDT subroutine as indicated at 718. The program then proceeds to return to the calling routine as indicated at 720.

Figure 15:
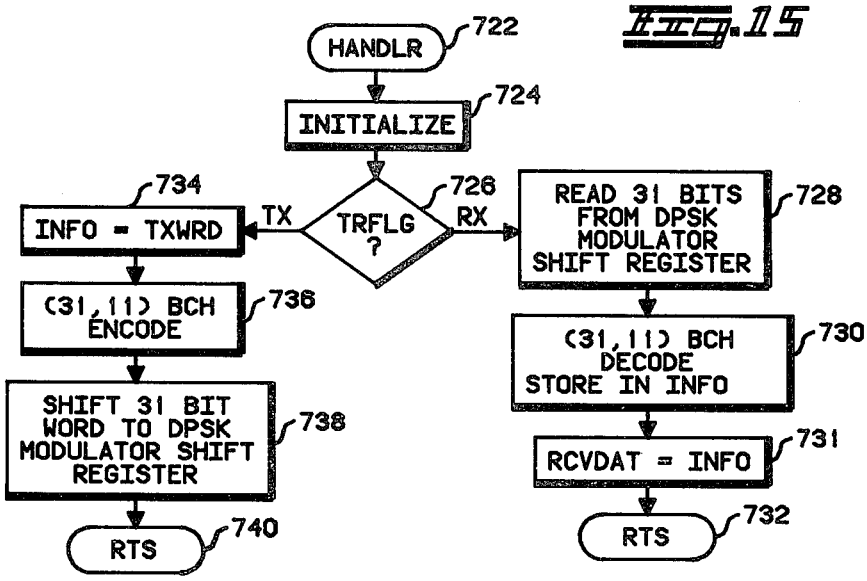
FIG. 15 is a program flow diagram of the HANDLR routine of the computer program for the central processor of the privacy scrambling system illustrated in FIG. 1.

The HANDLR subroutine indicated in FIG. 6 is shown in greater detail in FIG. 15. The HANDLR routine is entered at 722 and proceeds to block 724 where necessary variables are initialized and then to block 726 where TRFLG is tested to determine whether the system is in the transmit or receive mode. If in the transmit mode, program flow proceeds to block 734 where the variable encoder information word (INFO) is set equal to TXWRD. The program then proceeds to block 736 where INFO is (31,11) BCH encoded to provide a 31 bit encoded data word. Program flow then proceeds to block 738 where the 31 bit encoded data word is shifted to the DPSK modulator shift register shown in FIG. 5. The subroutine then returns to the calling routine, as indicated at block 740. If however, at block 726, the TRFLG test indicates that the system is in the receive mode, program flow proceeds to block 728, where the 31 bit data word is read from the DPSK modulator shift register shown in FIG. 5. Program then proceeds to block 730 where the 31 bit data word is (31,11) BCH decoded utilizing an algorithm described by J. L. Massey, (IEEE Transactions On Information Theory, Vol. IT-15, No. 1, January, 1969) and the result is stored as INFO. Program flow then proceeds to block 731 where RCVDAT is set equal to INFO after which the subroutine returns to the calling routine as indicated at 732.

Figure 16:
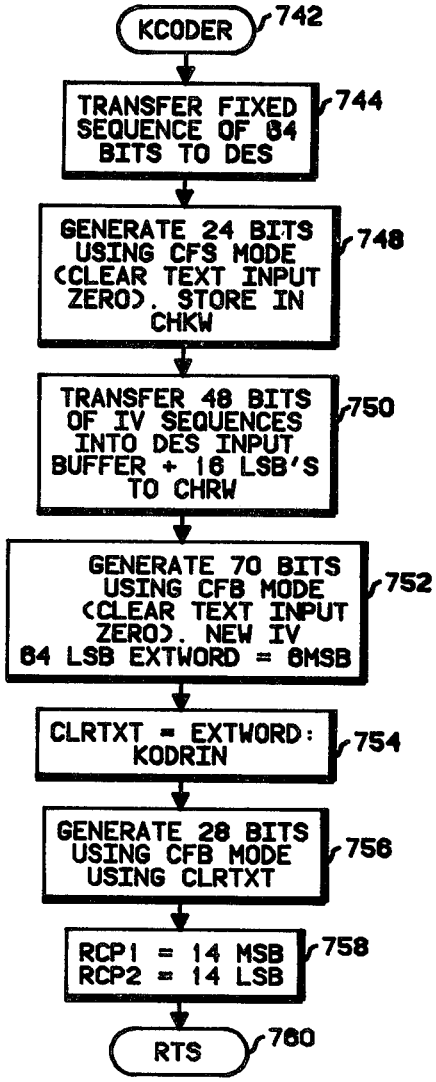
FIG. 16 is a program flow diagram of the KCODER routine of the computer program for the central processor of the privacy scrambling system illustrated in FIG. 1.

The detailed flow diagram for the background subroutine KCODER referred to in FIG. 6 is shown in FIG. 16. Referring to FIG. 16 the subroutine KCODER is entered at block 742 and program flow proceeds to block 744, where a randomly selected, fixed sequence of 64 bits are transferred to the DES input register. Program flow then proceeds to block 748 where a 24 bit word is generated using the cipher feedback mode of the DES with the clear text input equal to zero. The resulting 24 bit word is stored as CHKW. Program flow then proceeds to block 750 where the 48 bit IV sequence is transferred into a DES input register and concantenated (serially and to end combined) with the 16 least significant bits of the CHKW word thereby forming a 64 bit word which is then transferred to the DES input register. Program flow then proceeds to block 752 where a 70 bit word is generating using the cipher feedback mode with a clear text input equal to zero. The 70 bit word is stored with the 64 least significant bits as the new IV sequence and the 6 most significant bits as EXTWORD. Program flow then proceeds to block 754 where the 6 bits of EXTWORD are serially combined (ie., concatenated) with the 22 bits of coder input data (KODRIN) to produce a 28 bit word which is stored as CLRTXT. The program flow then proceeds to block 756, where a 28 bit word is generated using the cipher feedback mode with CLRTXT as the clear text input. Program flow then proceeds to block 758 where the 28 bit word generated is divided so that the 14 most significant bits are stored as RCP1 and the 14 least significant bits are stored as RCP2. The subroutine then returns to the calling routine, as indicated at 760.

The MEMMAP subroutine indicated in FIG. 6 is shown in greater detail in FIG. 17. The MEMMAP subroutine is entered at 762 and proceeds to block 764 where the four least significant bits of RECP determine the basic permutation using a table PRMTBL. The result is stored as working permutation (WPRM). The permutation table (PRMTBL) is made up of 16 permutation of the eight segments, chosen to maximize security of the scrambled audio. The program flow then proceeds to block 766, where the next four bits of RECP are used to select the frequency inversion code from a frequency inversion table (FITBL) made up of 16 different frequency inversion combinations. The result is stored as TFCODE. Program flow then proceeds to block 768 where the next two bits of RECP are used to modify the permutation selected at 764, and stored as WPRM. At this point the 2 bits are used to permute the WPRM permutation word such that a total of 48 permutations are possible. Program flow flow then proceeds to block 770 where the next four bits of RECP are used to select a time inversion code from a time inversion table (TITBL) which is made up of a total of 16 time inversion combinations. The result is stored as TEMPTI. Program flow then proceeds to block 772 where TRFLG is tested to determine whether the system is in the transmit or receive mode. If in the receive mode program control proceeds to block 776 where the inverse of the permutation determined above is calculated and stored as inverse working premutation (WPRMMI), to be used for decoding of the received scrambled information. Program flow then proceeds to block 778. If at block 772, the system was in the transmit mode, then program flow proceeds directly to 774, where the variable WPRMMI is set equal to the previously determined WPRM, and then program flow proceeds directly to block 778. At block 778 the TFCODE and TEMDTI are used to set up a table of time and frequency inversion requirements for each segment. As indicated at 780, the PRODUCT subroutine entry point occurs immediately after block 778. Program flow then proceeds to 782 where the count variable TMPCT is set equal to 8, which is due to the fact that there are 8 segments to a frame. Program flow then proceeds to block 784, where the product (PROD) is set equal to the variable previous permutation (PRVPRM) permutation multipled by WPRMNI. This permutation multiplication produces the required permutation for the next frame, and the result is used to calculate the addresses required code the audio information, which are stored in the memory map table (MEMTBL). In addition, the frequency inversion flag is moved into MEMTBL to indicate whether the segment is to be inverted. Program flow then proceeds to block 786 where INDFLG is set equal to the output direction flag (OTDFLG) which is equal to the Exclusive-OR result of previous time inversion Exclusive ORed with the current time inversion for the segment. The result from the Exclusive-OR operation is then used to modify the memory map to determine whether the data for the associated segment is transferred in forward or reverse direction. Program flow then proceeds to block 788 where TMPCT is decremented and then to 790 where TMPCT is tested to determine if it is equal to zero. If it is not equal to zero, program control returns to block 784 and the cycle continues until TMPCT is equal to zero. When TMPCT is equal to zero program flow proceeds to block 792 where PRVPRM is set equal to PROD. The subroutine then returns to the calling routine as indicated at 794.

Figure 18:
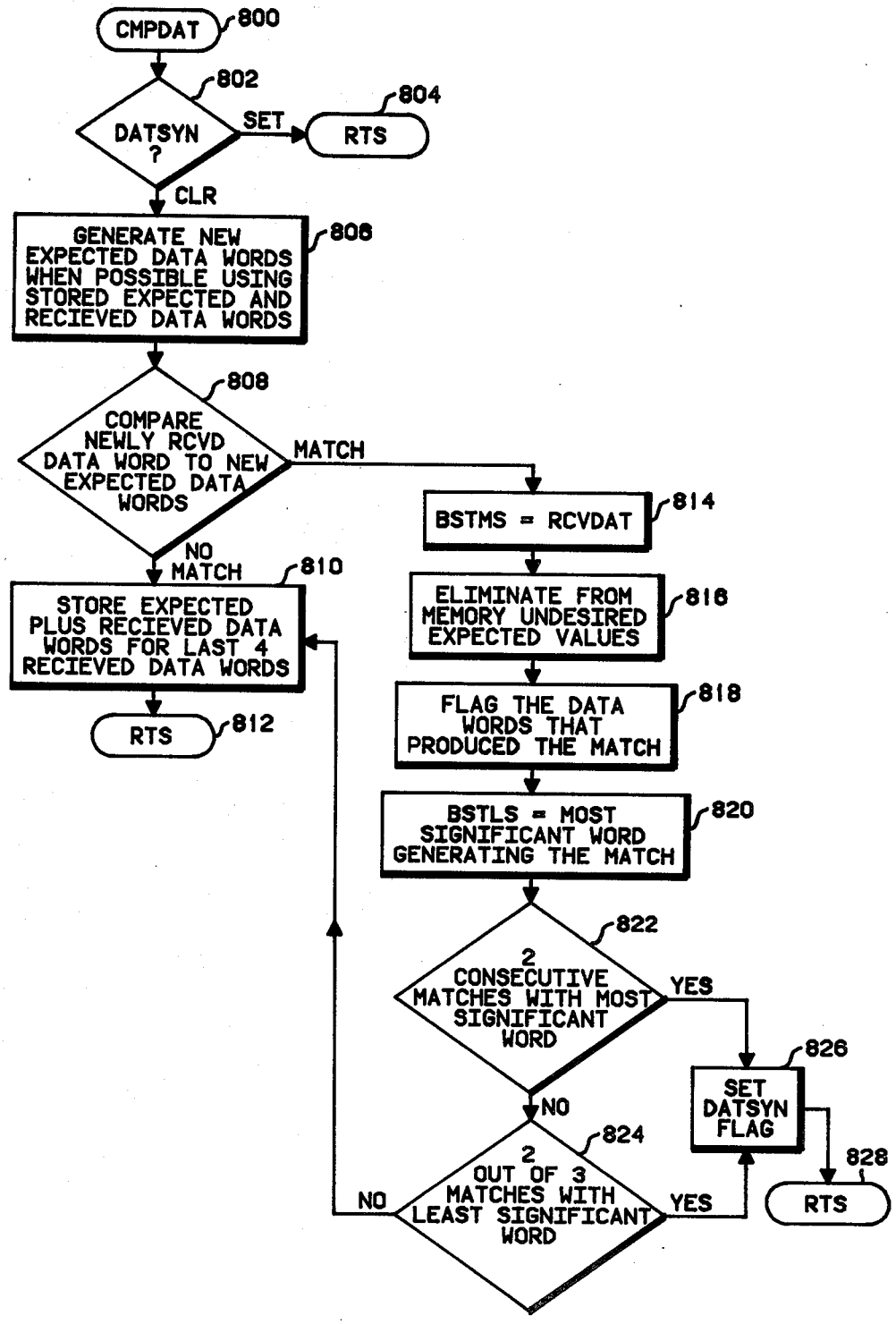
FIG. 18 is a program flow diagram of the CMPDAT routine of the computer program for the central processor the privacy scrambling system illustrated in FIG. 1.

The detailed flow diagram for the CMPDAT subroutine is shown in FIG. 18. The CMPDAT is entered as shown at 800 and program flow proceeds to 802 where DATSYN is tested to determine whether it is set or cleared. If DATSYN flag is set, the subroutine returns to the calling routine as indicated 804. If DATSYN is clear program, flow proceeds to block 806 where new expected data words are generated based on previously stored expected data words and previously received data words. Program flow then proceeds to block 808, where the newly received data word is compared to the newly calculated expected data words. If no match is found, then program flow proceeds to block 810 where the expected data words and received data words corresponding to the last 4 received data words are stored. The subroutine then returns to the calling routine, as indicated at 812. However, if a match is found at 808, program flow proceeds to block 814, where BSTMS is set equal to RCVDAT. Program flow then proceeds to block 816, where the undesired expected values are eliminated from memory after which the data words that produced the match are flagged, as indicated at 818. Program flow then proceeds to block 820 where BSTLS is set equal to the most signficant word generating the match. The program then proceeds to block 822 where a test is made to determine if two consecutive matches have been found with the most significant word. If no, then program flow then proceeds to block 824, where a second test is made to determine if two out of three matches with the least significant word that produced the match have occurred. If the result is again no, the program flow proceeds to block 810 and then returns to the calling routine, as indicated at 812. If however, the result of the match either at 822 or 824 is yes, program control proceeds to block 826, where DATSYN is set, indicating the system is in data sync. The subroutine then returns to the calling routine, as indicated at 828.

Figure 19:
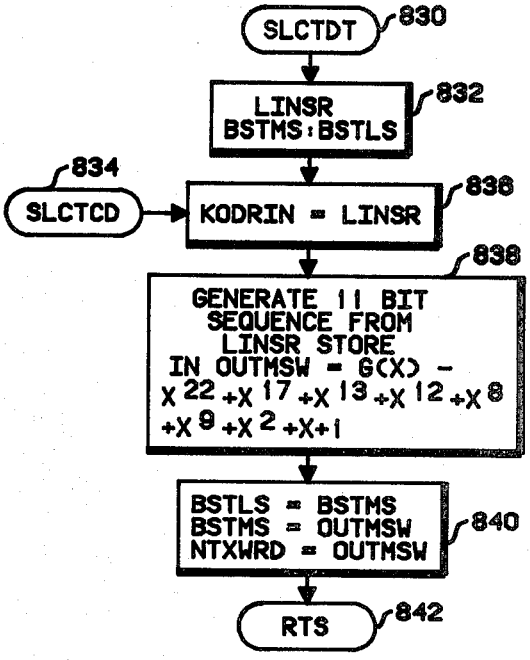
FIG. 19 is a program flow diagram of the SLCTDT routine of the computer program for the central processor of the privacy scrambling system illustrated in FIG. 1.

The detailed flow diagram for the SLCTDT and the SLCTCD subroutine is shown in FIG. 19. The SLCTDT subroutine is entered as shown at 830 and program flow proceeds to block 832 where the linear shift register (LINSR) is filled by serially entering the two words, BSTSM and BSTLS (ie., concatenating the two data words). Program flow then proceeds to block 836 where KODRIN is set equal to the contents of the linear shift register, LINSR. In addition, as shown at 834, the block 836 is the entry point for the subroutine SLCTCD. Program flow proceeds from block 836 to block 838 as shown where an 11 bit data sequence is generated from the contents of LINSR and stored in out most significant word (OUTMSW). The generation of the new 11 bit sequence is performed using the generating polynomial g(x), indicated in block 838. The program flow then proceeds to block 840, where BSTLS is set equal to BSTMS, and BSTMS is set equal to OUTMSW and the variable NTXWRD is set equal to OUTMSW. The subroutine then returns to the calling routine, as indicated at 842.

In summary, an improved method for synchronizing the scrambling sequences of communicating scrambler units in a reliable and secure manner has been described. The method is particularly adapted for use in noiser fade prone environments and permits late entry of authorized third parties to the system.

While a preferred embodiment of the invention has been described and shown, it should be understood that other variations and modifications may be implemented. It is therefore contemplated to cover by the present application any and all modifications and variations that fall within the true spirit and scope of the basic underlying principles disclosed and claimed herein.

What is claimed is:

1. In a narrowband privacy communication system for communicating analog information, wherein frames of analog information are partitioned into subframes and subframes are scrambled to permit secure transmission, a key code synchronization method comprising the steps of:

(a) generating successive digital sequences containing time synchronization information and key synchronization information at a first station;

(b) scrambling each frame of the analog information such that the scrambling algorithm is derived from the key synchronization information;

(c) periodically transmitting throughout the scrambled transmission of analog information from the first station the digital sequences distributed between the scrambled frames of the analog information;

(d) detecting at a second station at least one transmitted digital sequence and the transmitted scrambled analog information;

(e) descrambling the scrambled analog information utilizing at least one of the digital sequences.

2. The key code synchronization method of claim 1 further comprising the steps of generating a pseudo-random sequence of key synchronization words and acquiring from any of the periodically transmitted key words synchronization to said pseudo-random sequence so that the scrambled analog information can be descrambled even if the second station begins receiving the scrambled information during the middle of a transmission.

3. The key code synchronization method of claim 1, wherein the step of generating successive digital sequences further comprises the steps of:

(a) generating a random digital initializing word;

(b) generating the successive digital sequences from a psuedo-random sequence utilizing the initializing word;

4. The key code synchronization method of claim 1, further comprising the steps of:

(f) providing key code word;

(g) encoding the successive digital sequences utilizing the key code word.

5. The key code synchronization method of claim 1, wherein the step of scrambling further comprises the steps of:

(a) permuting the sub-frame with each frame utilizing a scrambling algorithm derived from the encoded digital sequences;

(b) time-inverting and frequency-inverting selected sub-frame utilizing a scrambling algorithm derived from the encoded digital sequences.

6. The key code synchronization method of claim 1, where the step of transmitting further comprises the steps of:

(a) compressing each frame of analog information into a smaller time period than it originally occupied to provide blank interframe intervals between each frame;

(b) inserting the digital sequences into the interframe intervals.

7. The key code synchronization method of claim 6 wherein the step of transmitting further comprises the steps of:

(a) inserting a time synchronization word into alternate interframe intervals;

(b) inserting a key synchronization word into the remaining interframe intervals.

8. The key code synchronization method of claim 7 wherein the step of detecting at the second station further comprises the steps of:

(a) detecting the time synchronization word and generating synchronization pulses therefrom;

(b) recovering at least one of the key synchronization words.

9. The key code synchronization method of claim 1 wherein the step of descrambling further comprises the steps of:

(a) generating the inverse of the scrambling algorithm which produced the transmitted scrambled analog information from any one of the key synchronization words;

(b) descrambling the scrambled analog information utilizing the inverse scrambling algorithm.

10. The key code synchronization method of claim 1, or 9 further comprises the steps of:

(h) digitizing the analog information prior to scrambling;

(i) converting the scrambled digitized information to analog form after scrambling.

11. The key code synchronization method of claim 1, or 9, further comprising the steps of:

(j) digitizing the scrambled analog information at the second station before descrambling (k) converting the descrambled digitized information to analog form after descrambling.

12. Key code synchronization apparatus for a privacy communication system wherein frames of analog information are partitioned into subframes, and the subframes are scrambled to provide secure transmission, the key code synchronization apparatus capable of scrambling in a transmit mode and descrambling in a receive mode, comprising:

(a) means for generating, in the transmit mode, successive digital sequences containing time synchronization information and key synchronization information and for scrambling each frame of the analog information such that the scrambling algorithm utilized is derived from the key synchronization information, and for descrambling, in the receive mode, the scrambled information utilizing at least one of the digital sequences;

(b) means for periodically distributing the the time synchronization information and key synchronization information between the scrambled frames of the analog information, in the transmit mode, to provide a composite analog signal;

(c) means for transmitting the composite analog signal in the transmit mode;

(d) means for receiving the transmitted composite analog signal in the receive mode;

(e) means for recovering at least one digital sequence from the received composite analog signal.

13. The apparatus of claim 12 further comprising means for generating a pseudo-random sequence of key synchronization words and means for acquiring from any of the periodically transmitted key words synchronization to said pseudo-random sequence so that the scrambled analog information can be descrambled even if said receiving means begins receiving the scrambled information during the middle of a transmission.

14. A method for communicating secure messages comprising the steps of:

generating successive key synchronization words in a predetermined pseudo-random sequence;

scrambling the message by using an algorithm derived from the key words;

transmitting the scrambled message with the key words successively interleaved with the scrambled message throughout the duration of the message;

receiving at least a portion of the scrambled message and at least one of the successive key words;

reproducing said predetermined pseudo-random sequence of key words in response to the reception of at least one of said key words; and descrambling said received portion of the scrambled message in response to said reproduced sequence of key words thereby permitting the reception of the remainder of a scrambled message even if a first portion of the latter is not received.

15. The method according to claim 14 further comprising the steps of generating time synchronization words interleaved with the scrambled message throughout the duration of the message, receiving the time words, and achieving time synchronization between the transmitted message and the received message and between the transmitted key words and the reproduced key words.

16. The method according to claim 14 further comprising the steps of compressing in time portions of the message to be transmitted to define blank intervals between adjacent message portions and inserting into at least certain of said blank intervals the key words wherein the transmitted scrambled message and key words occupy the same communication channel.

17. The method according to claim 16 further comprising the step of generating time synchronization words and inserting the time words into other of said blank intervals wherein time words, key words, and the scrambled message are transmitted over the same communication channel.

* * * * *